US005100765A

United States Patent [19]

Fujimoto

[11] Patent Number: 5,100,765

[45] Date of Patent: Mar. 31, 1992

[54] METHOD FOR PROCESSING A SILVER HALIDE COLOR PHOTOGRAPHIC MATERIAL

[75] Inventor: Hiroshi Fujimoto, Kanagawa, Japan

[73] Assignee: Fuji Photo Film Co., Ltd., Kanagawa, Japan

[21] Appl. No.: 605,716

[22] Filed: Oct. 30, 1990

[30] Foreign Application Priority Data

Oct. 30, 1989 [JP] Japan ..... 1-282317

[51] Int. Cl.[5] ..... G03C 5/26

[52] U.S. Cl. ..... 430/434; 430/484; 430/485; 430/486; 430/489; 430/490

[58] Field of Search ..... 430/484, 485, 486, 490, 430/489, 434

[56] References Cited

U.S. PATENT DOCUMENTS

| | | | |
|---|---|---|---|
| 4,155,763 | 5/1979 | Hasebe et al. | 430/169 |
| 4,798,783 | 1/1989 | Ishikawa | 430/372 |
| 4,801,516 | 1/1989 | Ishikawa et al. | 430/380 |
| 4,842,993 | 6/1989 | Yagihara et al. | 430/484 |

FOREIGN PATENT DOCUMENTS

| | | | |
|---|---|---|---|
| 0329003 | 8/1989 | European Pat. Off. . | |
| 0343557 | 11/1989 | European Pat. Off. | 430/484 |

*Primary Examiner*—Hoa Van Le
*Attorney, Agent, or Firm*—Sughrue, Mion, Zinn, Macpeak & Seas

[57] ABSTRACT

A method for processing a silver halide color photographic material is disclosed which comprises processing an imagewise exposed silver halide color photographic material comprising a support having thereon at least one silver halide emulsion layer containing silver halide having a silver iodide content of at least 2 mol % with a color developing solution, wherein said color developing solution contains at least one compound represented by formula (I), bromide ion in an amount of from $1.0\times10^{-2}$ to $5.0\times10^{-1}$ mol per liter and iodide ion in an amount of not more than $1.0\times10^{-4}$ mol per liter:

(I)

wherein L represents an alkylene group; A represents a carboxy group, a sulfo group, a phosphone group, a phosphinic acid residual group, a hydroxy group, an unsubstituted amino group or an amino group which is substituted with an alkyl group, an unsubstituted ammonio group or an ammonio group which is substituted with an alkyl group, an unsubstituted carbomoyl group or a carbamoyl group which is substituted with an alkyl group, an unsubstituted sulfamoyl group of a sulfamoyl-group is substituted with an alkyl group, or an alkylsulfonyl group; and R represents a hydrogen atom or an alkyl group.

The method according to the present invention provides stable photographic performance and excellent image quality, even when a low level of replenishment is used for color development processing.

14 Claims, No Drawings

METHOD FOR PROCESSING A SILVER HALIDE COLOR PHOTOGRAPHIC MATERIAL

FIELD OF THE INVENTION

The present invention relates to a method for processing a silver halide color photographic material (hereinafter referred to simply as a color light-sensitive material), and more particularly, to a method for color development processing of a color light-sensitive material containing silver iodide using a low level of replenishment which provides stable photographic properties and excellent image quality.

BACKGROUND OF THE INVENTION

In recent years, a method for processing a silver halide color light-sensitive material using a reduced amount of replenishment for the development processing step has been highly desired from the standpoint of simplification of the processing method and prevention of environmental pollution.

The amount of replenishment for continuous color development processing varies depending on the type of color light-sensitive material, and is generally from 700 to 1300 ml per square meter of a color light-sensitive material for photographing being processed.

When the amount of replenishment is reduced, problems generally arise in that photographic performance varies due to the relative increase in the amount of components (for example, halide ions formed upon decomposition of silver halide) contained in the color developing solution which are released from the color light-sensitive material, solution, and in that staining is generated after processing and the photographic performance is changed by deterioration of the color developing solution which is caused by the increase in the retention time of the solution in the processing tank.

In order to solve the former problems of variation in photographic performance such as sensitivity and gradation and particularly the deterioration of granularity at a low exposed area, upon the continuous processing, a method has been proposed for preventing the decrease in sensitivity, stabilizing gradation and minimum density by increasing the processing temperature or pH. However, the attempt to compensate the variation in photographic performance due to halide ion by adjusting the processing temperature or pH generally results in degradation of color balance and an increase in staining.

With respect to the latter problem of deterioration of the color developing solution upon oxidation, the use of hydroxylamine derivatives substituted with an alkyl group have been proposed as disclosed, for example, in U.S. Pat. No. 4,810,516, JP-A-63-4234 and JP-A-63-106655 (the term "JP-A" as used herein means an "unexamined published Japanese patent application"), in order to increase the stability of the color developing solution. Some of these compounds exhibit a certain degree of preservability in a low level replenishment system for a color developing solution, and do not adversely affect photographic performance and do not stain high silver chloride content type color light-sensitive materials. However, it has been found that the above noted compounds are not effective when processing color light-sensitive materials comprising a silver halide containing silver iodide. Furthermore, other problems occur in that the variation of photographic properties such as minimum density ($D_{min}$), sensitivity, granularity and gradation and staining in the uncolored portions is increased. These problems are particularly pronounced in a low level replenishment system.

SUMMARY OF THE INVENTION

An object of the present invention is to provide a method for continuously processing a color light-sensitive material containing silver iodide in a color developing solution having improved stability and which provides stable photographic performance.

A second object of the present invention is to provide a method for processing a color light-sensitive material in which the above described object is still attained even when the amount of replenishment for the color developing solution is reduced.

Other objects of the present invention will become apparent from the following description and examples.

The above objects of the present invention are accomplished with a method for processing a silver halide color photographic material which comprises processing an imagewise exposed silver halide color photographic material comprising a support having thereon at least one silver halide emulsion layer containing silver halide having a silver iodide content of at least 2 mol % with a color developing solution, wherein said color developing solution contains at least one compound represented by formula (I), bromide ion in an amount of from $1.0\times10^{-2}$ to $5.0\times10^{-1}$ mol per liter and iodide ion in an amount of not more than $1.0\times10^{-4}$ mol per liter:

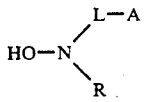

(I)

wherein L represents an alkylene group; A represents a carboxy group, a sulfo group, a phosphono group, a phosphinic acid residual group, a hydroxy group, an unsubstituted amino group or an amino group which is substituted with an alkyl group, an unsubstituted ammonio group or an ammonio group which is substituted with an alkyl group, an unsubstituted carbamoyl group or a carbamoyl group which is substituted with an alkyl group, an unsubstituted sulfamoyl group or a sulfamoyl group which is substituted with an alkyl group, or an alkylsulfonyl group; and R represents a hydrogen atom or an alkyl group.

DETAILED DESCRIPTION OF THE INVENTION

The compound represented by formula (I) is described in detail below.

In formula (I), L preferably represents a straight chain or branched chain alkylene group having from 1 to 10 carbon atoms, more preferably from 1 to 5 carbon atoms, which may be substituted. Preferred examples of the alkylene group represented by L include methylene, ethylene, trimethylene, and propylene. Useful substituents for L include a carboxy group, a sulfo group, a phosphono group, a phosphinic acid residual group, a hydroxy group, and an unsubstituted ammonio group or an ammonio group which is substituted with an alkyl group. Among them, a carboxy group, a sulfo group, a phosphono group and a hydroxy group are preferred as the substituents.

In formula (I), A represents a carboxy group, a sulfo group, a phosphono group, a phosphinic acid group, a hydroxy group, an unsubstituted amino group or an amino group which is substituted with an alkyl group, an unsubstituted ammonio group or an ammonio group which is substituted with an alkyl group, an unsubstituted carbamoyl group or a carbamoyl group which is substituted with an alkyl group, an unsubstituted sulfamoyl group or a sulfamoyl group which is substituted with an alkyl group, or an alkylsulfonyl group which may be substituted with substituents for L, and preferably represents a carboxy group, a sulfo group, a hydroxy group, a phosphono group, an unsubstituted carbamoyl group or a carbamoyl group which is substituted with an alkyl group.

Preferred examples of -L-A include carboxymethyl, carboxyethyl, carboxypropyl, sulfoethyl, sulfopropyl, sulfobutyl, phosphonomethyl, phosphonoethyl, and hydroxyethyl. Among them, carboxymethyl, carboxyethyl, sulfoethyl, sulfopropyl, phosphonomethyl, and phosphonoethyl are particularly preferred.

In formula (I), R preferably represents a hydrogen atom or a straight chain or branched chain alkyl group having from 1 to 10 carbon atoms, more preferably from 1 to 5 carbon atoms, which may be substituted. Useful substituents include a carboxy group, a sulfo group, a phosphono group, a phosphinic acid residual group, a hydroxy group, an unsubstituted amino group or an amino group which is substituted with an alkyl group, an unsubstituted ammonio group or an ammonio group which is substituted with an alkyl group, an unsubstituted carbamoyl group or a carbamoyl group which is substituted with an alkyl group, an unsubstituted sulfamoyl group or a sulfamoyl group which is substituted with an alkyl group, or an alkylsulfonyl group which may be substituted with substituents for L, an acylamino group, an alkylsulfonylamino group, an arylsulfonylamino group, an alkoxycarbonyl group, an arylsulfonyl group, a nitro group, a cyano group, and a halogen atom. The group R may have two or more substituents. Preferred examples of R include hydrogen, carboxymethyl, carboxyethyl, carboxypropyl, sulfoethyl, sulfopropyl, sulfobutyl, phosphonomethyl, phosphonoethyl, and hydroxyethyl. Among them, hydrogen, carboxymethyl, carboxyethyl, sulfoethyl, sulfopropyl, phosphonomethyl, and phosphonoethyl are particularly preferred.

In formula (I), A or the substituents for R may be a salt of alkali metals such as sodium and potassium. L and R may combine together to form a ring.

Specific examples of the compounds represented by formula (I) are set forth below, but the present invention is not to be construed as being limited thereto.

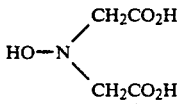
(1)

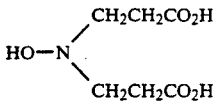
(2)

-continued

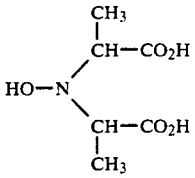
(3)

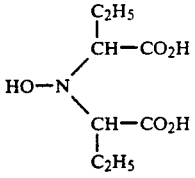
(4)

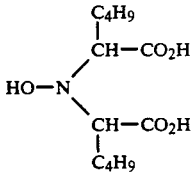
(5)

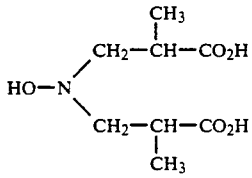
(6)

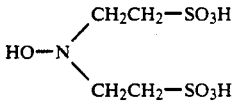
(7)

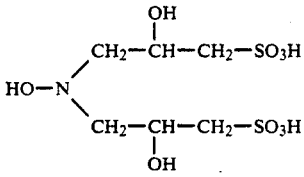
(8)

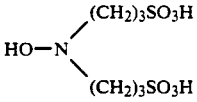
(9)

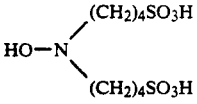
(10)

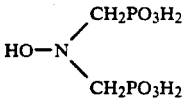
(11)

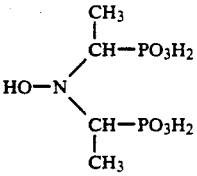
(12)

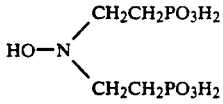
(13)

-continued
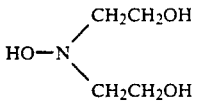
(14)
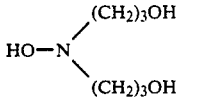
(15)
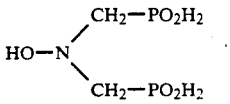
(16)
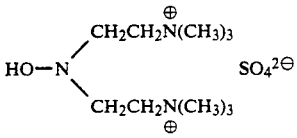
(17)
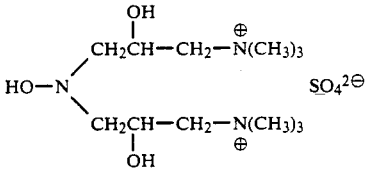
(18)
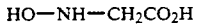
(19)
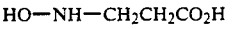
(20)
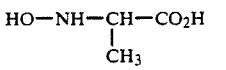
(21)
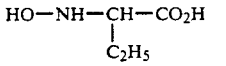
(22)
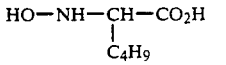
(23)
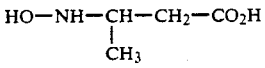
(24)
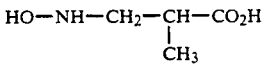
(25)
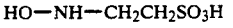
(26)
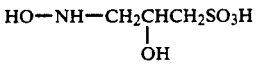
(27)
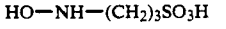
(28)
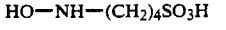
(29)
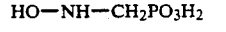
(30)
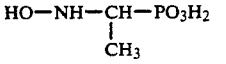
(31)
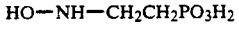
(32)
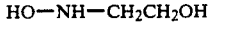
(33)
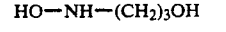
(34)
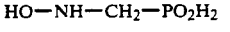
(35)
-continued
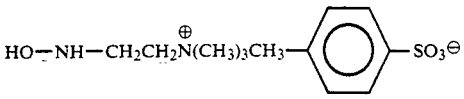
(36)
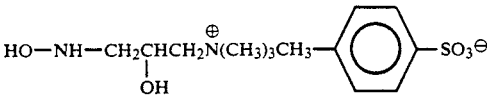
(37)
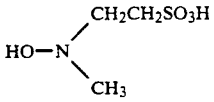
(38)
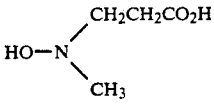
(39)
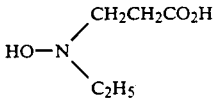
(40)
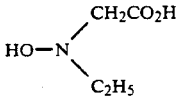
(41)
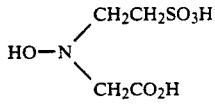
(42)
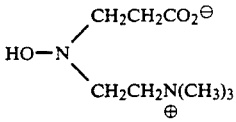
(43)
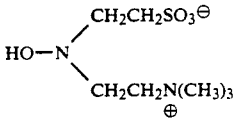
(44)
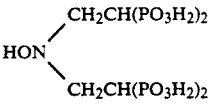
(45)
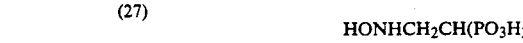
(46)
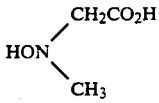
(47)
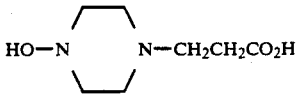
(48)
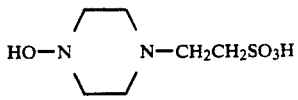
(49)

-continued (50)

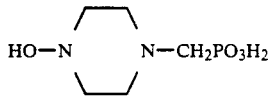

(51)

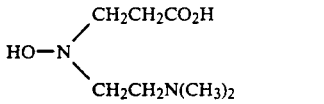

(52)

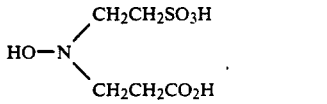

(53)

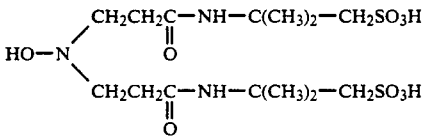

(54)

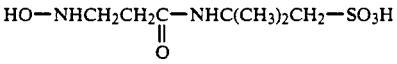

(55)

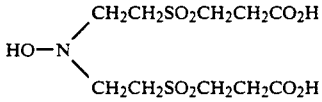

The compounds represented by formula (I) can be synthesized by alkylation (nucleophilic replacement reaction, addition reaction or Mannich reaction) of a commercially available hydroxylamine. Particularly, the compounds represented by formula (I) can be synthesized according to synthesis methods as described, for example, in West German Patent 1,159,634 and *Inorganica Chimica Acta,* Vol. 93, pages 101 to 108 (1984). Specific examples of synthesis of the compound represented by formula (I) are provided below.

SYNTHESIS EXAMPLE 1

Synthesis of Compound (7)

To 200 ml of an aqueous solution containing 20 g of hydroxylamine hydrochloride were added 11.5 g of sodium hydroxide and 96 g of sodium chloroethanesulfonate. The mixture was maintained at 60° C., and 40 ml of an aqueous solution containing 23 g of sodium hydroxide was gradually added thereto over a period of 1 hour, followed by reaction at 60° C. for 3 hours. The reaction solution was concentrated under reduced pressure, and to the resulting residue was added 200 ml of concentrated hydrochloric acid, followed by heating at 50° C. After removing the insoluble components by filtration, to the filtrate was added 500 ml of methanol to obtain 41 g (yield: 53%) of the Compound (7) as a monosodium salt.

SYNTHESIS EXAMPLE 2

Synthesis of Compound (11)

To an aqueous hydrochloric acid solution containing 7.2 g of hydroxylamine hydrochloride and 18.0 g of phosphorous acid was added 32.6 g of formalin, and the mixture was refluxed by heating for 2 hours. The crystals thus formed were recrystallized from water and methanol to obtain 9.2 g (yield: 42%) of Compound (11).

The color developing solution contains a compound represented by formula (I) in an amount of preferably from 0.1 to 50 g, more preferably from 0.2 to 20 g, per liter of the color developing solution.

The compound of formula (I) may be added to the color light-sensitive material and released to (i.e., eluted into) the color developing solution upon processing in the amount described above.

The compound of formula (I) effectively act as a preservative for the color developing agent when employed in the amount described above. Furthermore, the compound of formula (I) can also be present in a bleaching solution, a bleach-fixing solution, washing water or a stabilizing solution to be used instead of washing water. In the latter case, the compound of formula (I) is effective with respect to the color developing agent or oxidation product thereof carried over from the color developing solution present in each the above processing solution, to provide good results.

Two or more compounds of formula (I) may be used in combination, and the mixing ratio thereof is appropriately selected.

Furthermore, the compound represented by formula (I) can be used together with a known preservative, for example, a sulfite, a bisulfite, a hydroxamic acid, a hydrazine, a hydrazide, a phenol, an α-hydroxyketone, α-aminoketone, a saccharide, a monoamine, a diamine, a polyamine, a quaternary ammonium salt, a nitroxy radical, an alcohol, an oxime, a diamide compound, and a condensed cyclic amine.

The color developing solution of the present invention, preferably also contains, a compound represented by formula (II) in order to enhance the effects of the present invention:

(II)

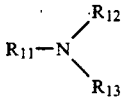

wherein $R_{11}$ represents a hydroxyalkyl group having from 2 to 6 carbon atoms, and $R_{12}$ and $R_{13}$ each represents a hydrogen atom, an unsubstituted alkyl group having from 1 to 6 carbon atoms, a hydroxyalkyl group having from 2 to 6 carbon atoms, a benzyl group or the group

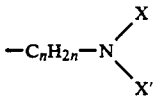

(wherein n represents an integer of from 1 to 6; X and X' each represents a hydrogen atom, an unsubstituted alkyl group having from 1 to 6 carbon atoms or a hydroxyalkyl group having from 2 to 6 carbon atoms).

Preferred examples of the compound represented by formula (II) are set forth below, but the present invention is not to be construed as being limited thereto.

(II-1) Ethanolamine
(II-2) Diethanolamine
(II-3) Triethanolamine
(II-4) Diisopropanolamine
(II-5) 2-Methylaminoethanol
(II-6) 2-Ethylaminoethanol
(II-7) 2-Dimethylaminoethanol
(II-8) 2-Diethylaminoethanol (II-9) 1-Diethylamino-2-propanol
(II-10) 3-Diethylamino-1-propanol
(II-11) 3-Dimethylamino-1-Propanol
(II-12) Isopropylaminoethanol
(II-13) 3-Amino-1-propanol
(II-14) 2-Amino-2-methyl-1,3-propanediol
(II-15) Ethylenediaminetetraisopropanol
(II-16) Benzylethanolamine
(II-17) 2-Amino-2-(hydroxymethyl)-1,3-propanediol
(II-18) 1,3-Diaminopropanol
(II-19) 1,3-Bis(2-hydroxyethylmethylamino)propanol Of the above described compounds, (II-1), (II-2), and (II-3) are most preferred.

The color developing solution contains a compound represented by formula (II) in an amount of preferably from 3 to 100 g, more preferably from 6 to 50 g per liter of the color developing solution of the present invention.

The color developing solution of the present invention further preferably contains a compound represented by formula (B-I) or (B-II) in order to enhance the effects of the present invention:

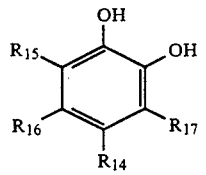

(B-I)

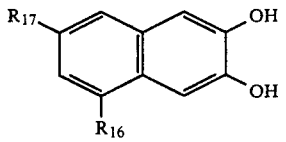

(B-II)

wherein $R_{14}$, $R_{15}$, $R_{16}$ and $R_{17}$ each represents a hydrogen atom, a halogen atom, a sulfonic acid group, an alkyl group having from 1 to 7 carbon atoms, $—OR_{18}$, $—COOR_{19}$,

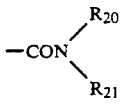

or a phenyl group; and $R_{18}$, $R_{19}$, $R_{20}$ and $R_{21}$; each represents a hydrogen atom or an alkyl group having from 1 to 18 carbon atoms, provided that when $R_{15}$ represents —OH or a hydrogen atom, $R_{14}$ represents a halogen atom, a sulfonic acid group, an alkyl group having from 1 to 7 alkyl group, $—OR^{18}$—$COOR^{19}$,

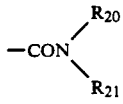

or a phenyl group.

The alkyl group represented by $R_{14}$, $R_{15}$, $R_{16}$ or $R_{17}$ includes an alkyl group which may be substituted with substituents for L. Useful examples of the alkyl group include methyl, ethyl, isopropyl, n-propyl, tert-butyl, n-butyl, hydroxymethyl, hydroxyethyl, carboxymethyl, and benzyl The alkyl group represented by $R_{18}$, $R_{19}$, $R_{20}$ or $R_{21}$ has the same meaning as above and further includes octyl. Useful examples of the phenyl group represented by $R_{14}$, $R_{15}$, $R_{16}$ and $R_{17}$ include phenyl, 2-hydroxyphenyl, and 4-aminophenyl.

Representative examples of the chelating agent represented by formulae (B-I) and (B-II) are provided below, but the present invention is not to be construed as being limited thereto.

(B-I-1) 4-Isopropyl-1,2-dihydroxybenzene
(B-I-2) 1,2-Dihydroxybenzene-3,5-disulfonic acid
(B-I-3) 1,2,3-Trihydroxybenzene-5-carboxylic acid
(B-I-4) 1,2,3-Trihydroxybenzene-5-carboxymethyl ester
(B-I-5) 1,2,3-Trihydroxybenzene-5-carboxy-n-butyl ester
(B-I-6) 5-tert-Butyl-1,2,3-trihydroxybenzene
(B-I-7) 1,2-Dihydroxybenzene-3,4,6-trisulfonic acid
(B-II-1) 2,3-Dihydroxynaphthalene-6-sulfonic acid
(B-II-2) 2,3,8-Trihydroxynaphthalene-6-sulfonic acid
(B-II-3) 2,3-Dihydroxynaphthalene-6-carboxylic acid
(B-II-4) 2,3-Dihydroxy-8-isopropylnaphthalene
(B-II-5) 2,3-Dihydroxy-8-chloronaphthalene-6-sulfonic acid Of the above described compounds, 1,2-dihydroxybenzene-3,5-disulfonic acid (B-I-2) is particularly preferably employed in the present invention. This compound is also employed as an alkali metal salt such as a sodium salt or a potassium salt.

The compound represented by formula (B-I) or (B-II) described above is employed generally in an amount of from 5 mg to 15 g, preferably from 15 mg to 10 g, and more preferably from 25 mg to 7 g, per liter of the color developing solution of the present invention.

The color developing solution of the present invention contains bromide ion in an amount of from $1.0\times10^{-2}$ to $5.0\times10^{-1}$ mol per liter and iodide ion in an amount of not more than $1.0\times10^{-4}$ mol per liter as halide ion.

The present inventors have discovered that the variation of photographic performance such as $D_{min}$, the increase in staining after processing and particularly, granularity at a low exposed area are remarkably improved when a color light-sensitive material containing silver iodide is processed with the color developing solution of the present invention having the above noted bromide ion concentration and iodide ion concentration, and containing the compound represented by formula (I). These results are unexpected.

The photographic performance of a color light-sensitive material generally changes with a change in the bromide ion concentration and iodide ion concentration in the color developing solution. As the halide ion concentration in the color developing solution is increased, development is generally restrained, and $D_{min}$ as well as maximum density ($D_{max}$) decrease, resulting in soft gradation and decreasing sensitivity. On the other hand, as the halide ion concentration is decreased, $D_{max}$ reaches the maximum density corresponding to characteristics of coupler used, $D_{min}$ greatly increases, and gradation and sensitivity vary as $D_{min}$ changes. Of the halide ions, the iodide ion concentration imparts particularly large effects.

Further, the decrease in activity of the color developing solution due to the low replenishment rate processing easily influences the granularity of images and particularly the granularity at the low exposed area is easily deteriorated.

On the other hand, it is quite surprising that the above described exceptional effects of the present invention are obtained by the combined use of bromide ion in a concentration of from $1.0\times10^{-2}$ to $5.0\times10^{-1}$ mol per liter and an iodide ion in a concentration of not more than $1.0\times10^{-4}$ mol per liter and the compound represented by formula (I) in the color developing solution in accordance with the method of the present invention.

In order to maintain the halide ion concentration in the above described range, halide ion can be directly added to the color developing solution or may be released from (i.e., eluted from) the light-sensitive material during processing. In the case of directly adding halide ion to the color developing solution, any inorganic compound or organic compound which releases halide ion can be used, but an inorganic compound is generally employed.

Useful examples of compounds which supply bromide ion include an alkali metal bromide (e.g., sodium bromide, potassium bromide, and lithium bromide), an alkaline earth metal bromide (e.g., magnesium bromide and calcium bromide), a transition metal bromide (e.g., manganese bromide, nickel bromide, and cobalt bromide), and ammonium bromide. Of these compounds, potassium bromide and sodium bromide are preferred.

Useful examples of the compounds which supply iodide ion include potassium iodide, and ammonium iodide.

When the halide ion is supplied and released from the light-sensitive material during processing, the halide ion may be derived from a silver halide emulsion or from other additives contained in the light-sensitive material.

In the present invention, the bromide ion concentration is preferably from $1.5\times10^{-2}$ to $2\times10^{-1}$ mol per liter, more preferably from $2.5\times10^{-2}$ to $1\times10^{-1}$ mol per liter, and the iodide ion concentration is preferably from $1\times10^{-7}$ to $1.0\times10^{-2}$ mol per liter, more preferably from $5.0\times10^{-7}$ to $5.0\times10^{-5}$ mol per liter, most preferably from $5.0\times10^{-7}$ to $1.0\times10^{-5}$ mol per liter of the color developing solution.

In accordance with the method of the present invention, the amount of replenishment for the color developing solution is preferably not more than 700 ml more preferably from 100 to 600 ml, and particularly preferably from 200 to 500 ml, per square meter of the color light-sensitive material being processed.

The color developing solution for use in the present invention contains a known aromatic primary amine color developing agent. Preferred examples thereof are p-phenylenediamine derivatives. Useful examples of the p-phenylenediamine derivative are set forth below, but the present invention is not to be construed as being limited thereto.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(8-hydroxyethyl)amino]aniline
D-5: 2-Methyl-4-[N-ethyl-N-(8-hydroxyethyl-)amino]aniline
D-6: 4-Amino-3-methyl-N-ethyl-N-[8-(methanesulfonamido)ethyl]aniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11 4-Amino-3-methyl-N-ethyl-N-β-butoxyethylaniline Of these p-phenylenediamine derivatives described above, 2-methyl-4-[N-ethyl-N-(β-hydroxyethyl-)amino]aniline (D-5) and 4-amino-3-methyl-N-ethyl-N-[β-(methanesulfonamido)ethyl]aniline (D-6) are particularly preferred.

The p-phenylenediamine derivatives may be in the form of salt such as a sulfate, hydrochloride, sulfite, or p-toluenesulfonate.

The aromatic primary amine developing agent is used preferably in an amount of from about 0.1 to about 20 g, more preferably from about 0.5 to about 15 g per liter of the developing solution.

The color developing solution for use in the present invention preferably has a pH of from 9 to 12 and more preferably from 9 to 11.0. The color developing solution may also contain compounds that are known additives of a developing solution.

In order to maintain the pH of the color developing solution in the above-described range, various buffers are preferably employed. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). The amount of the buffer added to the color developing solution is preferably 0.1 mol or more and particularly preferably from 0.1 to 0.4 mol per liter of the color developing solution.

In addition, various chelating agents can be added to the color developing solution in accordance with the present invention for the purpose of preventing calcium or magnesium precipitation, or for improving the stability of the color developing solution.

Specific examples of the chelating agents for use in the color developing solution of the present invention are set forth below, but the present invention is not to be construed as being limited thereto.

Nitrilotriacetic acid
Diethyleneaminopentaacetic acid
Ethylenediaminetetraacetic acid
Triethylenetetraminehexaacetic acid
Nitrilo-N,N,N-trismethylenephosphonic acid
Ethylenediamine-N,N,N',N'-tetrakismethylenephosphonoic acid
1,3-Diamino-2-propanoltetraacetic acid
Trans-cyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetriacetic acid
Ethylenediamine-o-hydroxyphenylacetic acid
2-Phosphonobutane-1,2,4-tricarboxylic acid
1-Hydroxyethylidene-1,1-diphosphonic acid
N,N'-Bis(2-hydroxybenzyl)ethylenediamine-N,N'-diacetic acid
Catechol-3,4,6-trisulfonic acid
Catechol-3,5-disulfonic acid
5-Sulfosalicylic acid
4-Sulfosalicylic acid Of these chelating agents, ethylenediaminetetraacetic acid, ethylenetriaminepentaacetic acid, triethylenetetraminehexaacetic acid, 1,3-diaminopropanoltetraacetic acid, ethylenediamine-N,N,N',N'-tetrakismethylenepsophonic acid, and hydroxyethyliminodiacetic acid are preferred.

Two or more chelating agents may be employed together, if desired.

The chelating agent is added to the color developing solution in an amount sufficient to mask metal ions contained therein. For example, the chelating agent is added to the color developing solution in an amount of from about 0.1 to about 10 g per liter.

The color developing solution of the present invention may contain a development accelerator, if desired.

Examples of useful development accelerators include thioether type compounds as described in JP-B-37-16088, JP-B-37-5987, JP-B-38-7826, JP-B-44-12380, JP-B-45-9019 and U.S. Pat. No. 3,813,247; p-phenylenediamine type compounds as described in JP-A-52-49829 and JP-A-50-15554; quaternary ammonium salts as described in JP-A-50-137726, JP-B-44-30074, JP-A-56-156826 and JP-A-52-43429; amine type compounds as described in U.S. Pat. Nos. 2,494,903, 3,128,182, 4,230,796, 3,253,919, 2,482,546, 2,596,926, and 3,582,346 and JP-B-41-11431; polyalkylene oxides as described in JP-B-37-16088, JP-B-42-25201, JP-B-41-11431, JP-B-42-23883 and U.S. Pat. Nos. 3,128,183 and 3,532,501; 1-phenyl-3-pyrazolidones; and imidazoles.

The color developing solution of the present invention preferably does not substantially contain benzyl alcohol. The term "substantially not contain benzyl alcohol" means that the color developing solution contains benzyl alcohol in an amount not more than 2.0 ml per liter of the solution, and preferably contains no benzyl alcohol. The color developing solution of the present invention which substantially does not contain benzyl alcohol provides preferred results with respect to the variation of photographic performance, and particularly, the increase in staining is reduced as the continuous processing proceeds.

The color developing solution of the present invention may contain antifoggants, if desired, in addition to iodide ion and bromide ion. An organic antifoggant may be employed. Representative examples of useful organic antifoggants include nitrogen-containing heterocyclic compounds such as benzotriaxole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

The color developing solution of the present invention may contain a sulfite such as sodium sulfite, potassium sulfite, sodium bisulfite, potassium bisulfite, sodium metabisulfite and potassium metabisulfite, and an adduct of carbonyl sulfinic acid. An amount of these compounds added is preferably from 0.5 to 10 g, more preferably from 1 to 5 g, per liter of the color developing solution.

The color developing solution of the present invention can contain a compound represented by formula (I). The compound represented by formula (I) is a compound directly preserving a color developing agent. In the present invention, it is preferable that hydroxyamine and derivatives thereof having no "A" of formula (I) are not substantially used is combination. The term "not substantially used" as used herein means the amount of the used hydroxyamine and derivatives thereof is 0.01 mol/l or less and preferably 0 mol/l.

The color developing solution of the present invention may contain a fluorescent brightening agent. As a fluorescent brightening agent, 4,4'-diamino-2,2'-disulfostilbene type compounds are preferred. The addition amount of the fluorescent brightening agent is generally from 0 to 5 g and preferably from 0.1 to 4 g per liter of the color developing solution.

Furthermore, the color developing solution of the present invention may contain various surface active agents such as alkylsulfonic acids, arylphosphonic acids, aliphatic carboxylic acids, and aromatic carboxylic acids, if desired.

The color developing processing time in accordance with the present invention is generally from 30 to 300 seconds, and preferably from 45 to 200 seconds in view of the remarkable effects of the present invention. Furthermore, the processing temperature is generally from 30 to 45° C., preferably from 35 to 40° C. in view of the remarkable effects of the present invention.

Moreover, the "opening rate" as defined below of a processing tank for the color developing solution in accordance with the present invention is preferably from 0 to 0.1 $cm^{-1}$ in view of stability of the color developing solution of the present invention.

$$\text{Opening rate} = \frac{\text{Contact area of processing solution with the air } (cm^2)}{\text{Volume of processing solution } (cm^3)}$$

In continuous processing, the opening rate is preferably from 0.001 to 0.05 $cm^{-1}$, and more preferably from 0.002 to 0.03 $cm^{-1}$ in practical use.

It is well known that when a hydroxylamine is used as a preservative, decomposition of color developing agent generally occurs upon heating or in the presence of a small amount of a metal, even if an opening rate of the tank for the color developing solution is minimized. On the other hand, with the color developing solution of the present invention, the above described decomposition is remarkably reduced, and the color developing solution has good preservability and is practically used in continuous processing with replenishment over a long time period. In view of the above, the opening rate is preferably as small as possible, and is most preferably from 0 to 0.002 $cm^{-1}$.

On the other hand, the processing solution may be discarded after a predetermined amount of the light-sensitive material is processed using a large opening rate. In such a case, the excellent properties of the present invention are also obtained.

The effects of the present invention are further enhanced by using means for reducing the opening rate, for example, use of a floating cover, a seal with a liquid having a higher boiling point and a lower specific gravity as compared to the developing solution, or a tank having a narrow slit opening as described in JP-A-63-131138.

The present invention can be applied to both processing using an automatic developing machine and manual processing, but is preferably practiced using an automatic developing machine. When using an automatic developing machine, one or more tanks for the color developing solution can be employed. For the purpose of conducting a lower level of replenishment, it is preferred to use a multistage orderly current replenishment system comprising a plurality of tanks, and wherein the replenishment is first introduced into the first tank and the overflow solution is introduced into the next tank in sequential order.

Furthermore, in order to enhance the effects of the present invention, it is preferred to supply water to the color developing solution in an amount corresponding to the amount of evaporation in order to compensate for concentration of the developing solution. Water added to the color developing solution is preferably deionized water obtained by ion exchange treatment, reverse osmosis treatment or distillation.

In the present invention, the color developing solution and the color developing replenisher are prepared by adding the above chemicals in sequential order into the predetermined amount of water, and the above deionized water is preferably used as the water.

In accordance with the present invention, the silver halide color photographic material is imagewise exposed, subjected to color development processing as described above, and then processed with a processing solution having a bleaching ability.

The processing solution having a bleaching ability for use in the present invention is a processing solution which oxidizes metallic silver formed by the development reaction and colloidal silver contained in the photographic material to convert to a soluble silver salt such as a silver thiocyanate complex salt or an insoluble silver salt such as silver bromide. The processing solution having a bleaching ability includes, for example, a bleaching solution and a bleach-fixing solution.

Bleaching agents for use in the processing solution include oxidizing agents, for example, ferric complex salts such as fericyanide iron complex and ferric citrate complex, persulfates, or peroxides such as hydrogen peroxide, but aminopolycarboxylic acid ferric complex salts, i.e., complex salts of ferric ion and aminopolycarboxylic acids or the salts thereof, is preferably employed.

Useful examples of the aminopolycarboxylic acids and salts thereof are set forth below.

(1) Diethylenetriaminepentaacetic acid
(2) Diethylenetriaminepentaacetic acid pentasodium salt
(3) Ethylenediamine-N-(β-oxyethyl)-N,N',N'-triacetic acid
Ethylenediamine-N-(β-oxyethyl)-N,N',N'-triacetic acid trisodium salt
Ethylenediamine-N0(β-oxyethyl)-N,N',N'-triacetic acid triammonium salt
(6) 1,2-Diaminopropanetetraacetic acid
(7) 1,2-Diaminopropanetetraacetic acid disodium salt
(8) Nitrilotriacetic acid
(9) Nitrilotriacetic acid sodium salt
(10) Cyclohexanediaminetetraacetic acid
(11) Cyclohexanediaminetetraacetic acid disodium salt
(12) N-Methyliminodiacetic acid
(13) Iminodiacetic acid
(14) Dihydroxyethylglycine
(15) Ethyl ether diaminetetraacetic acid
(16) Glycol ether diaminetetraacetic acid
(17) Ethylenediaminetetrapropionic acid
(18) 1,3-Diaminopropanetetraacetic acid
(19) Ethylendiaminetetraacetic acid As a matter of course, the aminopolycarboxylic acids or salts thereof are not limited to the above compounds.

Of the above-listed compounds, Compounds (1), (2), (6), (7) , (10), (11), (12), (16), (18) and (19) are particularly preferred.

The aminopolycarboxylic acid ferric complex salt may be used in the form of a complex salt or may be formed in a solution using a ferric salt such as ferric sulfate, ferric chloride, ferric nitrate, ammonium ferric sulfate, or ferric phosphate, and an aminopolycarboxylic acid. When using a complex salt, the complex salt may be used alone or in combination of two or more complex salts. On the other hand, when the complex salt is formed in a solution using a ferric salt and an aminopolycarboxylic acid, one or more kinds of the ferric salt may be used and also one or more kind of the aminopolycarboxylic acid may be used. Also, in any case, the aminopolycarboxylic acid(s) may be used in excess of the amount required for forming the ferric complex salt.

At least one of the above described ferric (Fe(III)) complex salts of the aminopolycarboxylic acids excluding Compound (19) and an ethylenediaminetetraacetic acid ferric complex salt may be used in combination.

Furthermore, the processing solution having a bleaching ability and containing the above described ferric complex salt may further contain a complex salt of a metal other than iron ion, such as cobalt ion, nickel ion, or copper ion.

The amount of the bleaching agent is generally from 0.1 to 1 mol, preferably from 0.2 to 0.5 mol per liter of the processing solution having a bleaching ability. Also, the pH of the bleaching solution is preferably from 2.5 to 8.0, and particularly preferably from 2.8 to 6.5.

The processing solution having a bleaching ability for use in the present invention may further contain a rehalogenating agent such as a bromide (for example, potassium bromide, sodium bromide, or ammonium bromide) and a chloride (for example, potassium chloride, sodium chloride, or ammonium chloride) in addition to the bleaching agent. Moreover, the processing solution may contain known additives for a conventional bleaching solution or bleach-fixing solution, including, for example, at least one of an inorganic acid, organic acid or salt thereof having a pH buffering function, such as a nitrate (for example, sodium nitrate, or ammonium nitrate), boric acid, borax, sodium metaborate, acetic acid, sodium acetate, sodium carbonate, potassium carbonate, phosphorus acid phosphoric acid, sodium phosphate, citraic acid, sodium nitrate, or tartaric acid.

In the present invention, a fixing bath following the bleaching bath or a processing bath having a bleach-fixing ability may contain a known fixing agent such as a thiosulfate (for example, sodium thiosulfate, ammonium thiosulfate, ammonium sodium thiosulfate, or potassium thiosulfate), a thiocyanate (for example, ammonium thiocyanate, or potassium thiocyanate), thiourea, or thioether. In the present invention, a thiosulfate, particularly ammonium thiosulfate, is preferably employed. The addition amount of the fixing agent is preferably about 3 mols or less, particularly preferably 2 mols or less per liter of the processing solution having a fixing ability or a bleach-fixing ability.

The processing solution having a bleach-fixing ability for use in the present invention may further contain a sulfite ion releasing compound such as a sulfite (for example, sodium sulfite, or ammonium sulfite), a bisulfite, or a bisulfite addition product of an aldehyde (for example, carbonyl bisulfite). The sulfite ion releasing compound is preferably used in an amount of from about 0.02 to about 0.50 mol per liter of the processing solution in terms of sulfite ion.

Furthermore, the processing solution having a bleach-fixing ability may contain an aminopolycarboxylic acid or salt thereof as described above or an organic phosphonic acid compound such as ethylenediaminetetrakismethylenephosphonic acid, diethylenetriaminepentakismethylenephosphonic acid, 1,3-diaminopropanetetrakismethylenephosphonic acid, nitro-N,N,N-trimethylenephosphonic acid, or 1-hydroxyethylidene-1,1'-diphosphonic acid.

In accordance with the present invention, the processing solution having a bleaching ability can further contain at least one bleaching accelerator selected from compounds having a mercapto group or a disulfide bond, isothiourea derivatives, and thiazolidine derivatives. The addition amount of the bleaching accelerator is preferably from $1\times10^{-5}$ to $1\times10^{-1}$ mol, particularly preferably from $1\times10^{-4}$ to $5\times10^{-2}$ mol, per liter of the processing solution having a bleach-fixing ability.

As described above, the bleaching accelerator which can be contained in the processing solution having a bleaching ability of the present invention is selected from compounds having a mercapto group or a disulfide bond, thiazolidine derivatives, thiourea derivatives, and isothiourea derivatives each having a bleach-accelerating effect. Useful bleaching accelerators include those represented by formulae (a) to (g) and the specific examples thereof as described in JP-A-63-163853.

The bleaching accelerator described above is generally added to the processing solution having a bleaching ability as a solution thereof in water, an alkaline aqueous solution, an organic acid, or an organic solvent, etc. The bleaching accelerator may be added to the processing solution in the form of a powder without adversely effecting the bleach-accelerating property.

Furthermore, a bleaching accelerator can be incorporated into the color light-sensitive material of the present invention. In such a case, the bleaching accelerator may be incorporated into any one of a blue-sensitive emulsion layer, a green-sensitive emulsion layer and a red-sensitive emulsion layer of the color light-sensitive material or in another hydrophilic colloid layer (i.e., a gelatin layer) such as an uppermost layer, an intermediate layer or a lowermost layer of the color light-sensitive material.

The processing bath having a fixing ability may be a processing step composed of one processing tank or composed of two or more processing tanks. In the latter case, a multistage countercurrent system may be employed for the replenishment for the processing solution being supplied to the last processing tank in the operation sequence, or the processing solution may be successively circulated through plural tanks and the replenisher may be supplied to any one of the plural tanks.

The bleach-fixing solution or fixing solution for use in the present invention has a pH preferably from 3 to 8, and more preferably from 4 to 7. When the pH is lower than this range, degradation of the solution and leucolization of cyan dyes may be accelerated, although the desilvering property is improved. On the other hand, when the pH is higher than this range, desilvering may be retarded and staining tends to occur.

After a delivering step such as a fixing step or a bleach-fixing step, the silver halide color photographic material of the present invention is generally subjected to a water washing step and/or a stabilizing step.

The amount of water required for the water washing step varies depending on the characteristics of light-sensitive material (e.g. the nature of the components contained therein, for example, couplers, etc.), application thereof, temperature of the washing water, the number of water washing tanks (stages), the type of replenishment system employed (e.g., countercurrent or cocurrent), and other various conditions. The relationship between the number of water washing tanks and the amount of water in a multi-stage countercurrent system can be determined based on the method described in *Journal of the Society of Motion Picture and Television Engineers*, Vol. 64, pages 248 to 253 (May, 1955).

According to the multi-stage countercurrent system described in the above publication, the amount of washing water can be significantly reduced. However, the increase in residence time in the water washing tank tends to propagete bacteria, and other problems occur such as adhesion of floatage on the photographic material. In the method of the present invention, techniques for reducing the amount of calcium ion and magnesium ion in the wash water as described in JP-A-62-288838 can be used effectively. Furthermore, sterilizers, for example, isothiazolone compounds as described in JP-A-57-8542, cyabendazoles, chlorine type sterilizers such as sodium chloroisocyanurate, benzotriazoles, sterilizers as described in Hiroshi Horiguchi, *Bokin Bobai no Kagaku, Biseibutsu no Mekkin-, Sakkin, Bobai-Gijutsu*, edited by Eiseigijutsu Kai, Bokin-Bobaizai Jiten, edited by Nippon Bokin-Bobai Gakkin can be employed.

The pH of the washing water for use in the processing method of the present invention is generally from 4 to 9, and preferably from 5 to 8. The temperature of the washing water and time for the water washing step varies depending on characteristics or application of the light-sensitive material. However, a temperature of from 15° C. to 45° C. and a time period of from 20 sec. to 10 min., preferably from 25° C. to 40° C. and from 30 sec. to 5 min., is generally employed.

The light-sensitive material for use in the present invention can also be directly processed with a stabilizing solution in place of the above-described water washing step. In such a stabilizing process, any of the known methods as described in JP-A-57-8543, JP-A-58-14834, JP-A-59-184343, JP-A-60-220345, JP-A-60-238832, JP-A-60-239784, JP-A-60-239749, JP-A-61-4054 and JP-A-61-118749 can be employed. A stabilizing bath containing 1-hydroxyethylidene-1,1-diphosphonic acid, 5-chloro-2-methyl-4-isothiazolin-3-one, a bismuth compound and an ammonium compound is particularly preferably employed.

Furthermore, the stabilizing process may be conducted subsequent to the above-described water washing process. One example thereof is a stabilizing bath containing formalin and a surface active agent, which is employed as final bath in the processing of color light-sensitive materials for photographing.

The color light-sensitive material for use in the present invention may comprise at least one blue-sensitive silver halide emulsion layer, at least one green-sensitive silver halide emulsion layer and at least one red-sensitive silver halide emulsion layer provided on a support. The number of silver halide emulsion layers and light-insensitive layers and the order thereof are not particularly restricted. One typical example is a silver halide photographic material comprising a support having thereon at least one light-sensitive unit layer composed of a plurality of silver halide emulsion layers having substantially the same sensitivity but different photographic speeds. The light-sensitive unit layer has a sensitivity to any of blue light, green light and red light. In a multilayer silver halide color photographic material, unit light-sensitive layers are generally provided on the support in the order of a red-sensitive layer, a green-sensitive layer and a blue-sensitive layer. The order of these layers can be varied depending on the application. Furthermore, a layer structure wherein a light-sensitive layer having a different sensitivity is arranged between two layers having the same sensitivity, may be employed.

Various light-insensitive layers such as an intermediate layer can be provided between the above described silver halide light-sensitive layers or as the uppermost layer or the undermost layer.

Into such a intermediate layer, couplers and DIR compounds as described, for example, in JP-A-61-43748, JP-A-59-113438, JP-A-59-113440, JP-A-61-20037 and JP-A-61-20038 may be incorporated. Further, the intermediate layer may contain conventionally employed color mixing preventing agents.

The unit light-sensitive layer preferably has a two layer construction consisting of a high speed emulsion layer and a low speed emulsion layer as described, for example, in West German Patent 1,121,470 and British Patent 923,045. It is preferred that these layers are arranged in order of increasing speed from the support. Furthermore, a light-insensitive layer may be provided between silver halide emulsion layers. Moreover, a low speed emulsion layer may be provided further away from the support and a high speed emulsion layer may be provided on the side closest to the support as described, for example, in JP-A-57-112751, JP-A-62-200350, JP-A-62-206541 and JP-A-62-206543.

Specific examples of the layer construction include an order of a low speed blue-sensitive layer (BL)/a high speed blue-sensitive layer (BH)/a high speed green-sensitive layer (GH)/a low speed green-sensitive layer (GL)/a high speed red-sensitive layer (RH)/a low speed red-sensitive layer (RL), the BL layer being the farthest from the support, an order of BH/BL/GL/GH/RH/RL, or an order of BH/BL/GH/GL/RL/RH.

Furthermore, an order of a blue-sensitive layer/GH/RH/GL/RL, the blue-sensitive layer being the farthest from the support as described in JP-B-55-34932 may be employed. Moreover, an order of a blue-sensitive layer/GL/RL/GH/RH, the blue-sensitive layer being the farthest from the support as described in JP-A-56-25738 and JP-A-62-63936 may also employed.

Furthermore, a layer construction of three layers having different photographic speeds comprising an upper silver halide emulsion layer having the highest speed, an intermediate silver halide emulsion layer having a speed lower than that of the upper layer, and an lower silver halide emulsion layer having a speed lower than that of the intermediate layer in order of increasing speed from the support as described in JP-B-49-15495 may also be employed. When the unit light-sensitive layer of the same spectral sensitivity is composed of three layers having different speeds, an order of an intermediate (i.e., medium) speed emulsion layer/a high speed emulsion layer/a low speed emulsion layer, the intermediate speed emulsion layer being the farthest from the support may be employed as described in JP-A-59-202464.

As described above, various layer constructions and arrangement thereof may be appropriately selected depending on the application of the light-sensitive material.

The total thickness of all hydrophilic colloid (i.e., gelatin) layers positioned on the support is generally not more than 28 mμ, preferably not more than 20 mμ, and more preferably not more than 17 mμ, with respect to preferably achieving the effects of the present invention.

In the photographic silver halide emulsion layers of the light-sensitive material for use in the present invention, silver iodobromide, silver iodochloride or silver iodochlorobromide each containing from about 2 to 30 mol % of silver iodide is preferably employed. Silver iodobromide or silver iodochlorobromide each containing from about 2 mol % to about 25 mol % of silver iodide is particularly preferred.

The silver halide grains of the silver halide emulsion may have a regular crystal structure, for example, a cubic, octahedral or tetradecahedral structure, an irregular crystal structure, for example, a spherical or tabular structure, a crystal defect, for example, a twin plane, or a composite structure thereof.

The particle size of the silver halide is not particularly restricted, and includes a grain size ranging from fine grains having a diameter of projected area of about 0.2 micron or less to large size grains having a diameter of projected area of about 10 microns. Furthermore, a polydispersed emulsion and a monodispersed emulsion may be used.

The silver halide photographic emulsion for use in the present invention can be prepared using known methods, for example, those as described in *Research Disclosure,* No. 17643 (December, 1978), pages 22 to 23, "I. Emulsion Preparation and Types" and ibid., No. 18716 (November, 1979), page 648, P. Glafkides, *Chimie et Physique Photographique,* Paul Montel (1967), G.F. Duffin, *Photographic Emulsion Chemistry,* The Focal Press (1966), and V.L. Zelikman et al., *Making and Coating Photographic Emulsion,* The Focal Press (1964).

Monodispersed emulsions as described, for example, in U.S. Pat. Nos. 3,574,628 and 3,655,394, and British Patent 1,413,748 are preferably used in the present invention.

Further, tabular silver halide grains having an aspect ratio of about 5 or more can be employed in the present invention. The tabular grains are readily prepared by the method as described, for example, in Gutoff, *Photographic Science and Engineering,* Vol. 14, pages 248 to 257 (1970), U.S. Pat. Nos. 4,434,226, 4,414,310, 4,433,048 and 4,439,520, and British Patent 2,112,157.

The crystal structure of the silver halide grains may be uniform, or comprise of different halide compositions between the inner portion and the outer portion, or may have a stratified structure.

Furthermore, silver halide emulsions in which silver halide grains having different compositions are connected through epitaxial junctions or silver halide emulsions in which the silver halide grains contain compounds other than silver halide, such as silver thiocyanate, or lead oxide, may also be employed.

Moreover, a mixture of grains having different crystal structures may be used.

The silver halide emulsions used in the present invention are generally subjected to physical ripening, chemical sensitization and spectral sensitization. In the physical ripening step, various poly-valent metal ion impurities (for example, a salt or complex salt of a metal such as cadmium, zinc, lead, copper, thallium, iron, ruthenium, rhodium, palladium, osmium, iridium, or platinium) may be introduced. Compounds for use in the chemical sensitization include those described in JP-A-62-215272, page 18, right lower column to page 22, right upper column. Furthermore, various additives which can be employed in these steps are described in *Research Disclosure,* No. 17643, (December, 1978) and ibid., No. 18716 (November, 1979) as summarized in the Table below.

Furthermore, known photographic additives which can be used in the present invention are also described in the above noted publications, as summarized in the Table below.

| Kind of Additives | RD 17643 | RD 18716 |
|---|---|---|
| 1. Chemical Sensitizers | Page 23 | Page 648, right column |
| 2. Sensitivity Increasing Agents | — | Page 648, right column |
| 3. Spectral Sensitizers and Supersensitizers | Pages 23 to 24 | Page 648, right column to page 649, right column |
| 4. Whitening Agents | Page 24 | — |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

Furthermore, in order to prevent degradation of photographic properties due to formaldehyde gas, it is preferred to add a compound which reacts to fix formaldehyde as described in U.S. Pat. Nos. 4,411,987 and 4,435,503 to the light-sensitive material.

In the present invention, various color couplers can be employed and specific examples thereof are described in the patents cited in *Research Disclosure,* No. 17643, "VII-C" to "VII-G".

Preferred yellow couplers for use in the present invention include, for example, those as described in U.S. Pat. Nos. 3,933,501, 4,022,620, 4,326,024, 4,401,752 and 4,248,961, JP-B-58-10739, British Patents 1,425 020 and 1,476,760, U.S. Pat. Nos. 3,973,968, 4,314,023 and 4,511,649, and European Patent 249473A.

Preferred magenta couplers for use in the present invention include 5-pyrazolone type and pyrazoloazole type compounds. Magenta couplers as described, for example, in U.S. Pat. Nos. 4,310,619 and 4,351,897, European Patent 73,636, U.S. Pat. Nos. 3,061,432 and 3,725,067, *Research Disclosure,* No. 24220 (June, 1984), JP-A-60-33552, *Research Disclosure,* No. 24230 (June, 1984), JP-A-60-43659, JP-A-61-72238, JP-A-60-35730, JP-A-55-118034, JP-60-185951, and U.S. Pat. Nos. 4,500,630, 4,540,654 and 4,556,630, and WO(PCT) 88/04795 are particularly preferred.

Cyan couplers for use in the present invention include phenol type and naphthol type couplers. The cyan couplers as described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patents 121365A and 49453A, U.S. Pat. Nos. 3,446,622, 4,333,999, 4,753,871, 4,451,559, 4,427,767, 4,690,889, 4,254,212 and 4,296,199, and JP-A-61-42658 are preferred.

The colored couplers for correcting undesirable side absorptions of dye images as described, for example, in *Research Disclosure,* No. 17643, "VII-G", U.S. Pat. No. 4,163,670, JP-B-57-39413, U.S. Pat. Nos. 4,004,929 and 4,138,258, and British Patent 1,146,368 are preferably employed. Couplers which correct undesirable side absorptions of dye images by releasing fluorescent dyes at the time of coupling as described in U.S. Pat. No. 4,774,181, and couplers having, as a releasing group, a dye precursor moiety which forms a dye upon a reaction with a developing agent as described in U.S. Pat. No. 4,777,120 are also preferably employed.

Couplers which form diffusible dyes as described, for example, in U.S. Pat. No. 4,366,237, British Patent 2,125,570, European Patent 96,570, and West German Patent Application (OLS) No. 3,234,533 are preferably employed.

Typical examples of polymerized dye forming couplers for use in the present invention are described, for example, in U.S. Pat. Nos. 3,451,820, 4,080,211, 4,367,282, 4,409,320 and 4,576,910, and British Patent 2,102,173.

Couplers which release a photographically useful moiety upon coupling are preferably employed in the present invention. DIR couplers which release a development inhibitor as described, for example, in the patents cited in *Research Disclosure,* No. 17643, "VII-F" described above, JP-A-57-151944, JP-A-57-154234, JP-A-60-184248, JP-A-63-37346, and U.S. Pat. Nos. 4,248,962 and 4,782,012 are preferred.

Couplers which imagewise release a nucleating agent or a development accelerator at the time of development as described, for example, in British Patents 2,097,140 and 2,131,188, JP-A-59-157638, and JP-A-59-170840 are preferred.

Furthermore, competing couplers such as those described, for example, in U.S. Pat. No. 4,130,427; polyequivalent couplers such as those described, for example, in U.S. Pat. Nos. 4,283,472, 4,338,393 and 4,310,618; DIR redox compound or DIR coupler releasing couplers or DIR coupler or DIR redox compound releasing redox compound such as those described, for example, in JP-A-60-185950 and JP-A-62-24252; couplers capable of releasing a dye which turns to a colored form after being released such as those described, for example, in European Patent 173,302A; bleaching accelerator releasing couplers such as those described, for example, in *Research Disclosure,* No. 11449, ibid, No. 24241 and JP-A-61-201247; ligand releasing couplers such as those described, for example, in U.S. Pat. No. 4,553,477; couplers capable of releasing a leuco dye such as those described, for example, in JP-A-63-75747; and couplers which release a fluorescent dye such as those described, for example, in U.S. Pat. No. 4,774,181 may be employed in the light-sensitive material for use in the present invention.

The couplers for use in the present invention can be introduced into the light-sensitive material in accordance with various known dispersing methods.

Useful examples of an organic solvent having a high boiling point which can be employed in an oil droplet-in-water type dispersing method are described, for example, in U.S. Pat. No. 2,322,027.

Specific examples of the organic solvent having a high boiling point, and specifically a boiling point of not less than 175° C. at atmospheric pressure, which can be employed in the oil droplet-in-water type dispersing method include phthalic acid esters (for example, dibutyl phthalate, dicyclohexyl phthalate, di-2-ethylhexyl phthalate, didecyl phthalate, bis(2,4-di-tert-amylphenyl)phthalate, bis(2,4-di-tert-amylphenyl) isophthalate, or bis(1,1-diethylpropyl)phthalate); phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, or di-2-ethylhexyl phenyl phosphonate); benzoic acid esters (for example, 2-ethylhexyl benzoate, dodecyl benzoate, or 2-ethylhexyl-p-hydroxybenzoate); amides (for example, N,N-diethyldodecanamide, N,N-diethyllaurylamide, or N-tetradecylpyrrolidone); alcohols or phenols (for example, isostearyl alcohol, or 2,4-ditert-amylphenol); aliphatic carboxylic acid esters (for example, bis(2-ethylhexyl)-sebacate, dioctyl azelate, glycerol tributyrate, isostearyl lactate, or trioctyl citrate); aniline derivatives (for example, N,N-dibutyl-2-butoxy-5-tert-octylaniline); and hydrocarbons (for example, paraffin, dodecylbenzene, or diisopropylnaphthalene).

Furthermore, an organic solvent having a boiling point of at least about 30° C. and preferably having a boiling point of above 50° C. but below about 160° C. can be used as an auxiliary solvent. Useful examples of auxiliary solvents include ethyl acetate, butyl acetate, ethyl propionate, methyl ethyl ketone, cyclohexanone, 2-ethoxyethyl acetate, and dimethylformamide.

The processes and effects of latex dispersing methods for introducing the couplers into the light-sensitive material of the present invention and specific examples of latexes for loading are described, for example, in U.S. Pat. No. 4,199,363, West German Patent Application (OLS) Nos. 2,541,274 and 2,541,230.

Moreover, the couplers can be emulsified and dispersed in an aqueous solution of a hydrophilic colloid after being immersed in a loadable latex polymer as described, for example, in U.S. Pat. No. 4,203,716 in the presence or absence of the above described organic solvent having a high boiling point, or after the couplers are emulsification-dispersed in a polymer which is water-insoluble and organic solvent-soluble. Homopolymers and copolymers as described in WO(PCT) 88/00723, pages 12 to 30 are preferably employed. Particularly, acrylamide series polymers are preferably employed in view of stabilization of the color images thus formed.

The present invention can be applied to various color light-sensitive materials, and typical examples thereof include color negative films for general use or cinematography, and color reversal films for slides or television.

Suitable supports for use in the light-sensitive material of the present invention are described, for example, in *Research Disclosure,* No. 17643, page 28 and ibid., No. 18716, page 647, right column to page 648, left column, as mentioned above.

The total layer thickness of all of the hydrophilic colloid layers on the emulsion layer side of the light-sensitive material of the present invention is preferably not more than 28 μm and has a layer swelling rate $T_{\frac{1}{2}}$ of not more than 30 seconds. The layer thickness is the thickness measured after conditioning the material at a temperature of 25° C. and a relative humidity of 55% for 2 days. The layer swelling rate $T_{\frac{1}{2}}$ is determined according to known methods in the art. For example, the degree of swelling can be measured using a swellometer of the type described in A. Green, *Photogr. Sci. Eng.,* Vol. 19, No. 2, page 124 to 129. $T_{\frac{1}{2}}$ is defined as the time that it takes to reach a saturated layer thickness of 90% of the maximum swelling layer thickness obtained when treated in a color developing solution at 30° C. for 3 minutes and 15 seconds.

The layer swelling rate of $T_{\frac{1}{2}}$ can be controlled by adding a hardening agent to a gelatin binder or by changing the aging condition after coating.

The rate of swelling is preferably from 150% to 400%. The rate of swelling can be calculated using the formula (maximum swelling layer thickness—layer thickness)/layer thickness, wherein the maximum swelling layer thickness has the same meaning as defined above.

In accordance with the present invention, a method for processing a color light-sensitive material containing at least 2 mol % silver iodide is provided, using a color developing solution containing a hydroxylamine compound substituted with a specific alkyl group having a water-soluble group, and having a bromide ion concentration and an iodide ion concentration maintained within the prescribed ranges. The method of the present invention is stable and exhibits little variation in photographic performance such as minimum density, sensitivity, granularity and gradation under continuous processing. In the color image thus—obtained, the occurrence of staining upon long term storage is reduced.

The present invention is explained in greater detail with reference to the following examples, but the present invention should not be construed as being limited thereto.

EXAMPLE 1

A cellulose triacetate film support provided with a subbing layer was coated with the layers having the composition as set forth below, to prepare a multilayer color light-sensitive material designated Sample 101.

With respect to the compositions of the layers, the coating amounts of silver halide and colloidal silver are given in terms of the silver coating amount in g/m$^2$. The coating amounts of couplers, additives and gelatin are given in units of g/m$^2$, and the coating amounts of sensitizing dyes are given in units of mols per mol of silver halide contained in the same layer. All parts are given by weight, unless indicated otherwise.

The symbols which denote the additives used below are defined as follows. When the additive has two or more functions, one of the functions is indicated as being representative.

UV: Ultraviolet light absorbing agent
Solv: Organic solvent having a high boiling point
ExF: Dye
ExS: Sensitizing dye
ExC: Cyan coupler
ExM: Magenta coupler
ExY: Yellow coupler
Cpd: Additive

| First Layer: Antihalation Layer | |
|---|---|
| Black colloidal silver | 0.15 |
| Gelatin | 2.9 |
| UV-1 | 0.03 |
| UV-2 | 0.06 |
| UV-3 | 0.07 |
| Solv-2 | 0.08 |
| ExF-1 | 0.01 |
| ExF-2 | 0.01 |

| Second Layer: Low-Speed Red-Sensitive Emulsion Layer | |
|---|---|
| Silver iodobromide emulsion (AgI: 4 mol %, uniform AgI type, diameter corresponding to sphere: 0.4 μm, coefficient of variation of diameter corresponding to sphere: 37%, tabular grain, diameter/thickness ratio: 3.0) | 0.4 (as silver) |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |
| ExC-2 | 0.03 |
| ExC-3 | 0.13 |

| Third Layer: Intermediate (medium)-Speed Red-Sensitive Emulsion Layer | |
|---|---|
| Silver iodobromide emulsion (AgI: 6 mol %, internal high AgI type, with core/shell ratio of 2:1, diameter corresponding to sphere: 0.65 μm, coefficient of variation of diameter corresponding to sphere: 25%, tabular grain, diameter/thickness ratio: 2.0) | 0.65 (as silver) |
| Silver iodobromide emulsion (AgI: 4 mol %, uniform AgI type, diameter corresponding to sphere: 0.4 μm, coefficient of variation of diameter corresponding to sphere: 37%, tabular grain, diameter/thickness ratio: 3.0) | 0.1 (as silver) |
| Gelatin | 1.0 |
| ExS-1 | $2 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-2 | 0.01 |
| ExC-3 | 0.06 |

| Fourth Layer: High-Speed Red-sensitive Emulsion Layer | |
|---|---|
| Silver iodobromide emulsion (AgI: 6 mol %, internal high AgI type, with core/shell ratio of 2:1, diameter corresponding to sphere: 0.7 μm, coefficient of variation of diameter corresponding to sphere: 25%, tabular grain, diameter/thickness ratio: 2.5) | 0.9 (as silver) |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC-4 | 0.05 |
| Solv-1 | 0.07 |
| Solv-2 | 0.20 |
| Cpd-7 | $4.6 \times 10^{-4}$ |

| Fifth Layer: Intermediate Layer | |
|---|---|
| Gelatin | 0.6 |
| UV-4 | 0.03 |
| UV-5 | 0.04 |
| Cpd-1 | 0.1 |
| Polyethyl acrylate latex | 0.08 |
| Solv-1 | 0.05 |

| Sixth Layer: Low-Speed Green-Sensitive Emulsion Layer | |
|---|---|
| Silver iodobromide emulsion (AgI: 4 mol %, uniform AgI type, diameter corresponding to sphere: 0.4 μm, coefficient of variation of diameter corresponding to sphere: 37%, tabular grain. diameter/thickness ratio: 2.0) | 0.18 (as silver) |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |

| Seventh Layer: Intermediate-Speed Green-Sensitive Emulsion Layer | |
|---|---|
| Silver iodobromide emulsion (AgI: 4 mol %, surface high AgI type, with core/shell ratio of 1:1, diameter corresponding to sphere: 0.5 μm, coefficient of variation of diameter corresponding to sphere: 20%, tabular grain, diameter/thickness ratio: 4.0) | 0.27 (as silver) |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |

| Eighth Layer: High-Speed Green-Sensitive Emulsion Layer | |
|---|---|
| Silver iodobromide emulsion (AgI: 8.7 mol %, multi-layer structure grain having silver amount ratio of 3:4:2, AgI content: 24 mol %, 0 mol %, 3 mol % from the interior of the grain to the surface, respectively, diameter corresponding to sphere: 0.7 μm, coefficient of variation of diameter corresponding to sphere: 25%, tabular grain, diameter/thickness ratio: 1.6) | 0.7 (as silver) |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |

| Ninth Layer: Intermediate Layer | |
|---|---|
| Gelatin | 0.6 |
| Cpd-1 | 0.04 |
| Polyethyl acrylate latex | 0.12 |
| Solv-1 | 0.02 |

| Tenth Layer: Donor Layer of Interimage Effect to Red-Sensitive Layer | |
|---|---|
| Silver iodobromide emulsion (AgI: 6 mol %, internal high AgI type, with core/shell ratio of 2:1, diameter corresponding to sphere: 0.7 μm, coefficient of variation of diameter corresponding to sphere: 25%, tabular grain, diameter/thickness ratio: 2.0) | 0.68 (as silver) |
| Silver iodobromide emulsion (AgI: 4 mol %, uniform AgI type, diameter corresponding to sphere: 0.4 μm, coefficient of variation of diameter corresponding to sphere: 37%, tabular grain, diameter/thickness ratio: 3.0) | 0.19 (as silver) |
| Gelatin | 1.0 |
| ExS-3 | $6 \times 10^{-4}$ |
| ExM-10 | 0.19 |
| Solv-1 | 0.20 |

-continued

| | |
|---|---|
| **Eleventh Layer: Yellow Filter Layer** | |
| Yellow Colloidal Silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| **Twelfth Layer: Low-Speed Blue-sensitive Emulsion Layer** | |
| Silver iodobromide emulsion (AgI: 4.5 mol %, uniform AgI type, diameter corresponding to sphere: 0.7 μm, coefficient of variation of diameter corresponding to sphere: 15%, tabular grain, diameter/thickness ratio: 7.0) | 0.3 (as silver) |
| Silver iodobromide emulsion (AgI: 3 mol %, uniform AgI type, diameter corresponding to sphere: 0.3 μm, coefficient of variation of diameter corresponding to sphere: 30%, tabular grain, diameter/thickness ratio: 7.0) | 0.15 (as silver) |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| **Thirteenth Layer: Intermediate Layer** | |
| Gelatin | 0.7 |
| ExY-12 | 0.20 |
| Solv-1 | 0.34 |
| **Fourteenth Layer: High-Speed Blue-sensitive Emulsion Layer** | |
| Silver iodobromide emulsion (AgI: 10 mol %, internal high AgI type, diameter corresponding to sphere: 1.0 μm, coefficient of variation of diameter corresponding to sphere: 25%, multiple twin tabular grain, diameter/thickness ratio: 2.0) | 0.5 (as silver) |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |
| **Fifteenth Layer: First Protective Layer** | |
| Fine grain silver iodobromide emulsion (AgI: 2 mol %, uniform AgI type, diameter corresponding to sphere: 0.07 μm) | 0.12 (as silver) |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethyl acrylate latex | 0.09 |
| **Sixteenth Layer: Second Protective Layer** | |
| Fine grain silver iodobromide emulsion (AgI: 2 mol %, uniform AgI type, diameter corresponding to sphere: 0.07 μm) | 0.36 (as silver) |
| Gelatin | 0.55 |
| Polymethyl methacrylate particle (diameter: 1.5 μm) | 0.2 |
| H-1 | 0.17 |

Each layer described above further contained a stabilizer for the emulsion (Cpd-3: 0.07 g/m$^2$) and a surface active agent (Cpd-4: 0.03 g/m$^2$) as a coating aid in addition to the above described components.

The total thickness of all gelatin-containing layers was 18 μm.

The components used for the preparation of the light-sensitive material are illustrated below.

UV-1

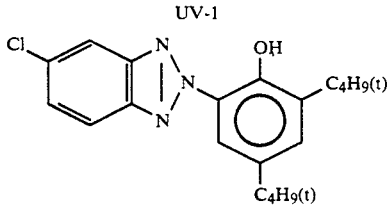

UV-2

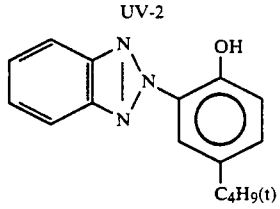

UV-3

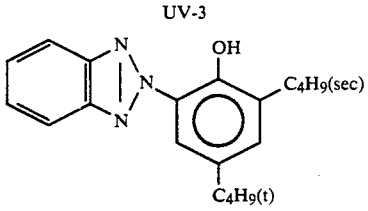

UV-4

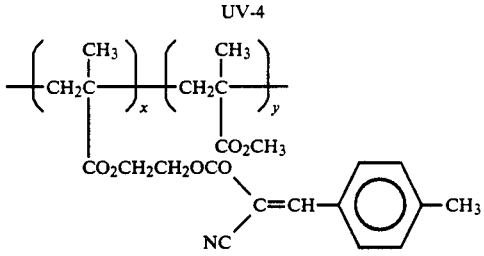

x:y = 70:30 (wt %)

UV-5

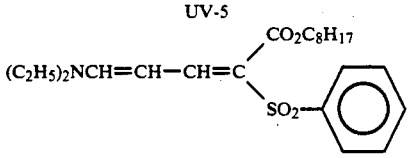

Solv-1
Tricresyl phosphate
Solv-2
Dibutyl phthalate
Solv-4

-continued
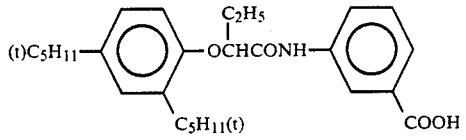
Solv-5
Trihexyl phosphate
ExF-1
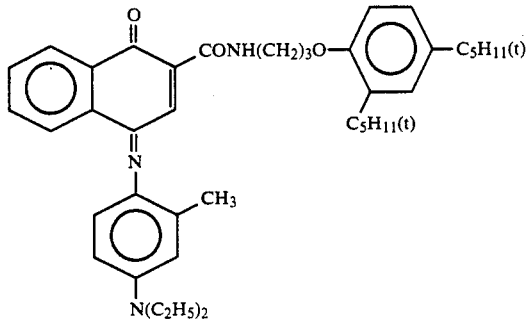
ExF-2
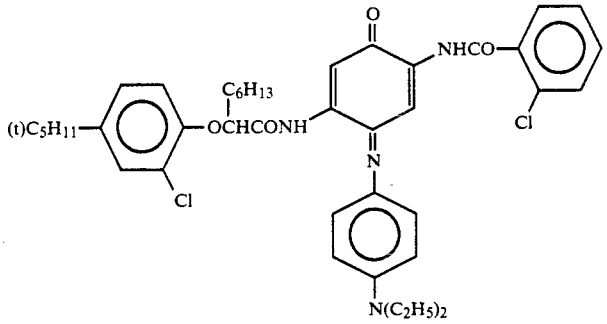
ExS-1
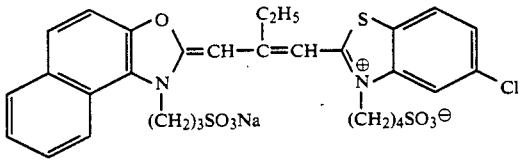
ExS-2
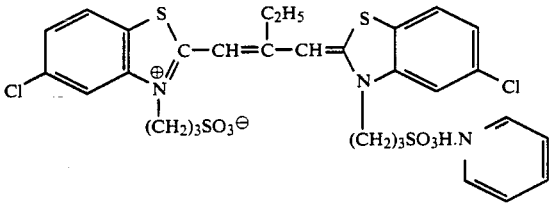
ExS-6
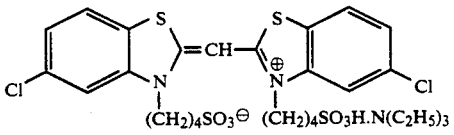
ExS-7
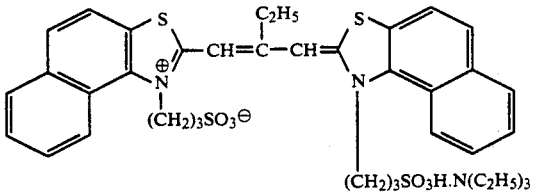
ExS-8
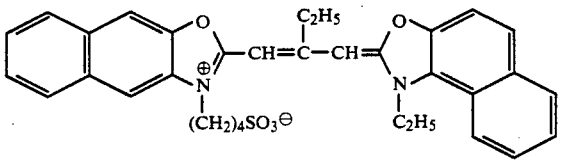
ExS-3

-continued
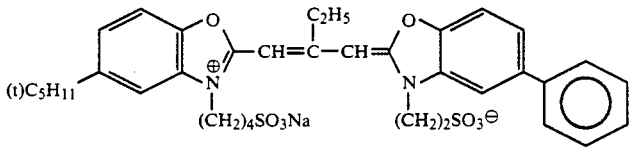
ExS-4
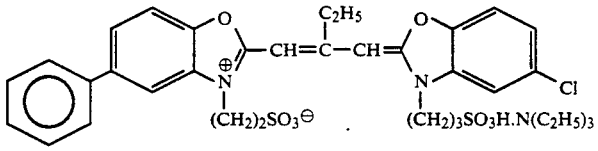
ExS-5
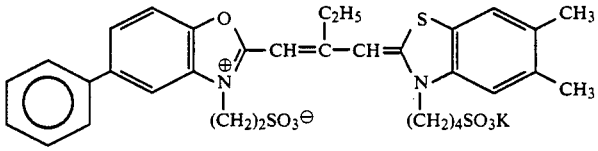
ExC-1
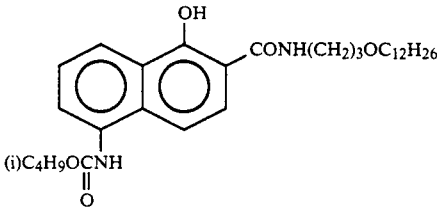
ExC-2
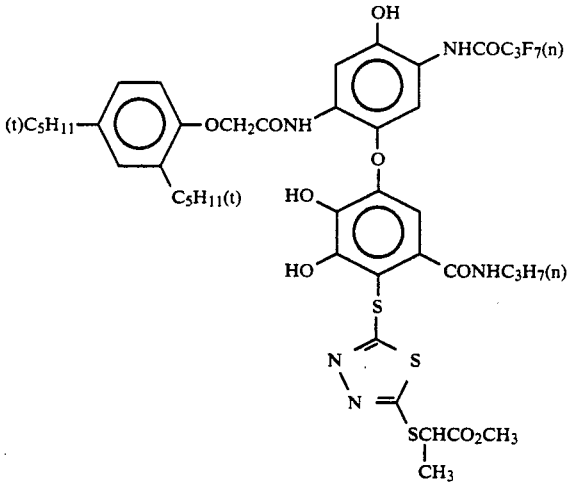
ExC-3 ExC-4

-continued
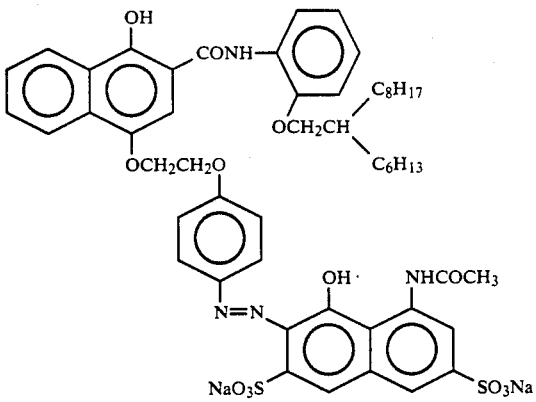
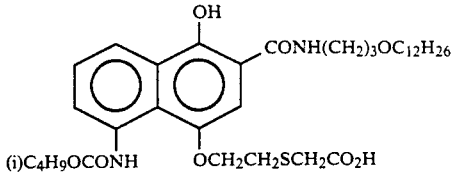
ExM-5
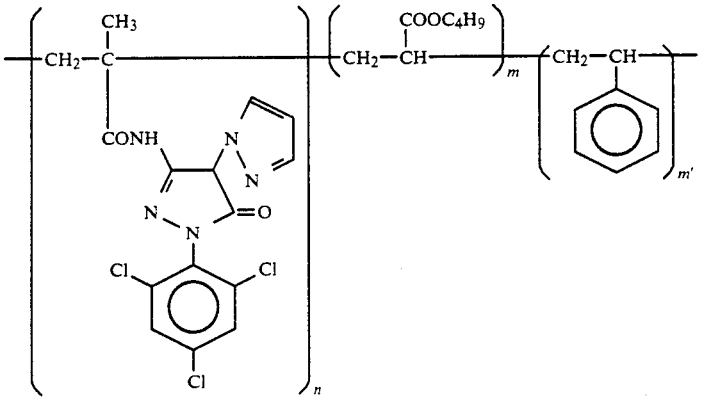
n = 50
m = 25
m' = 25
mol. wt. about 20,000
ExM-6
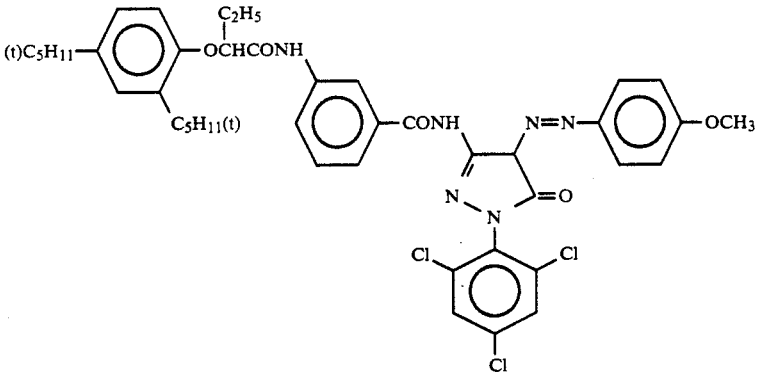
ExM-7

-continued
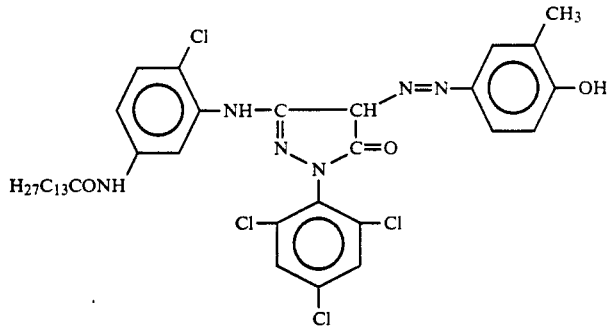
ExM-10
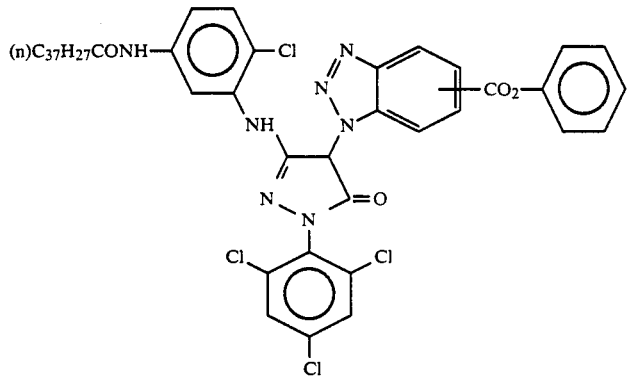
ExY-8
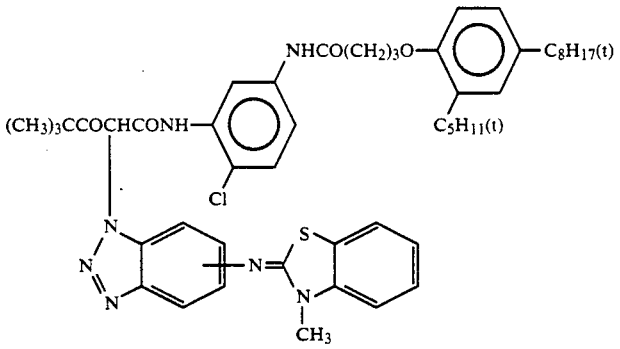
ExY-9
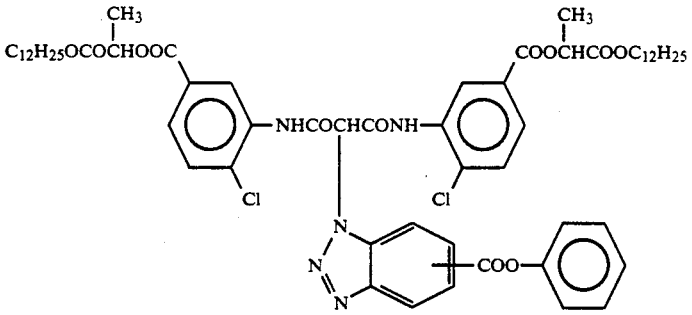
ExY-11

-continued
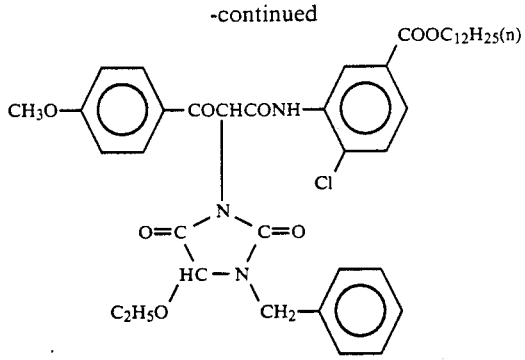
ExY-12
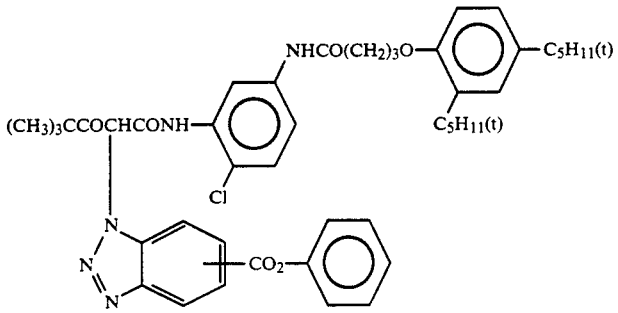
Cpd-7
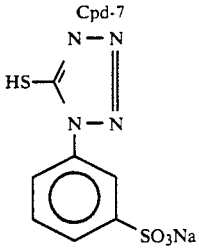
Cpd-1
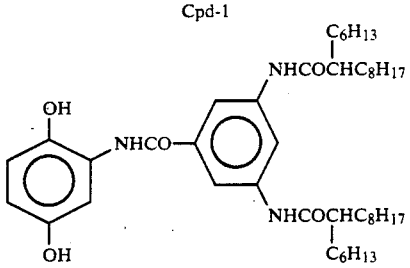
Cpd-2
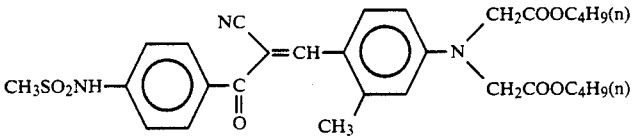
Cpd-6
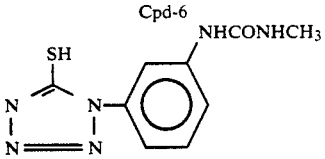
Cpd-5
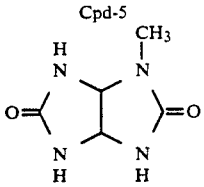
Cpd-3
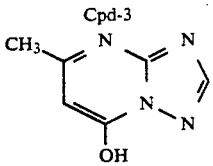
Cpd-4
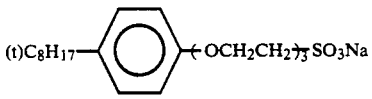
H-1
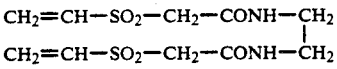
Sample 101 was cut into strips of 35 mm width, exposed through a step wedge using white light (color temperature of light source: 4800° K), and processed according to the processing steps described below using a color developing solution having a bromide ion concentration and an iodide ion concentration as indicated in Table 1-1 below. Then, the same imagewise exposed sample was continuously processed until the accumulated amount of replenisher for the color developing solution reached three times the tank capacity of start liquor. The photographic performance of the sample following the continuous processing was evaluated as described below. Also, the same sample was exposed and processed in the same manner as described for the evaluation of photographic performance prior to continuous processing.

| Processing Step | Processing Time | Processing Temperature (°C.) | Amount of* Replenishment (ml) | Tank Capacity (l) |
|---|---|---|---|---|
| Color Development | 3 min. 15 sec. | 38.0 | 600 | 15 |
| Bleaching | 50 sec. | 38.0 | 130 | 5 |
| Bleach-Fixing | 50 sec. | 38.0 | — | 5 |
| Fixing | 50 sec. | 38.0 | 800 | 5 |
| Washing with Water (1) | 30 sec. | 38.0 | — | 3 |
| Washing with Water (2) | 20 sec. | 38.0 | 800 | 3 |
| Stabilizing | 20 sec. | 38.0 | 530 | 3 |
| Drying | 1 min. | 55 | — | — |

*Amount of replenishment per $m^2$ of light-sensitive materials

The water washing was conducted using a countercurrent system from (2) to (1), and the entire overflow solution of the washing water was introduced into the fixing bath. The replenishment for the bleach-fixing bath was effected by connecting an upper portion of the bleaching tank with the bottom of the bleach-fixing tank by a pipe, and connecting an upper portion of the fixing tank with the bottom of the bleach-fixing tank by a pipe of an automatic developing machine, such that the entire overflow solution resulting from the supply of replenisher to the bleaching tank and fixing tank was introduced into the bleach-fixing tank. The amount of developing solution carried over to the bleaching step, the amount of bleaching solution carried over to the bleach-fixing step, the amount of bleach-fixing solution carried over to the fixing step and the amount of fixing solution carried over to the washing with water step were 2.5 ml, 2.0 ml and 2.0 ml per meter of a 35 mm wide light-sensitive material being processed, respectively. The crossover time for each type was 5 seconds, and this time is included in the processing time for the former step in the processing sequence.

The composition of each processing solution used is illustrated below.

| | Start Liquor | Replenisher |
|---|---|---|
| Color Developing Solution: | | |
| Diethylenetriaminepenta-acetic acid | 2.0 g | 2.2 g |
| 1-Hydroxyethylidene-1,1-diphosphonic acid | 3.3 g | 3.3 g |
| Sodium sulfite | 3.9 g | 5.2 g |
| Potassium carbonate | 37.5 g | 39.0 g |
| Potassium bromide | Shown in Table 1-1 | |
| Potassium iodide | Shown in Table 1-1 | |
| Compound (shown in Table 1-2) | $3.0 \times 10^{-2}$ mol | $4.5 \times 10^{-2}$ mol |
| 2-Methyl-4-(N-ethyl-N-(β-hydroxyethyl)amino)aniline sulfate | 4.5 g | 6.8 g |
| Water to make | 1.0 l | 1.0 l |
| pH | 10.05 | 10.15 |
| Bleaching Solution: | | |
| Ammonium iron(III) 1,3-propylenediaminetetra-acetate monohydrate | 144.0 g | 206.0 g |
| Ammonium bromide | 84.0 g | 120.0 g |
| Ammonium nitrate | 17.5 g | 25.0 g |
| Hydroxyacetic acid | 63.0 g | 90.0 g |
| Acetic acid | 33.2 g | 47.4 g |
| Water to make | 1.0 l | 1.0 l |
| pH (adjusted with aqueous ammonia) | 3.20 | 2.80 |

Bleach-Fixing Solution:

A mixed solution of the above described bleaching solution and the fixing solution described below in a ratio of 15:85 by volume.

| Fixing Solution: | Start Liquor | Replenisher |
|---|---|---|
| Ammonium sulfite | 19.0 g | 57.0 g |
| Ammonium thiosulfate aqueous solution (700 g/l) | 280 ml | 840 ml |
| Imidazole | 28.5 g | 85.5 g |
| Ethylenediaminetetraacetic acid | 12.5 g | 37.5 g |
| Water to make | 1.0 l | 1.0 l |
| pH | 7.40 | 7.45 |

Washing Water: (bath start liquor and replenisher)

City water was passed through a mixed bed type column filled with an H type strong acidic cation exchange resin ("Amberlite IR-120B" manufactured by Rohm & Haas Co.) and an OH type strong anion exchange resin ("Amberlite IRA-400" manufactured by Rohm & Haas Co.) to prepare water containing not more than 3 mg/l of calcium ion and magnesium ion, respectively. To the water thus—treated were added sodium dichloroisocyanulate in an amount of 20 mg/l and sodium sulfate in an amount of 150 mg/l. The pH of the solution was in the range of from 6.5 to 7.5.

| Stabilizing Solution: (bath start liquor and replenisher) | |
|---|---|
| Formalin (37 wt %) | 2.0 ml |
| Polyoxyethylene-p-monononylphenylether (average degree of polymerization: 10) | 0.3 g |
| Disodium Ethylenediaminetetraacetate | 0.05 g |
| Water to make | 1.0 l |
| pH | 5.0 to 8.0 |

TABLE 1-1

| Processing Solution | Concentration of Potassium Bromide Start Liquor (mol/l) | Concentration of Potassium Bromide Replenisher (mol/l) | Concentration of Potassium Iodide Start Liquor (mol/l) | Concentration of Potassium Iodide Replenisher (mol/l) |
|---|---|---|---|---|
| A | $0.5 \times 10^{-2}$ | 0 | $5.0 \times 10^{-4}$ | $1.0 \times 10^{-4}$ |
| B | $0.5 \times 10^{-2}$ | 0 | $1.0 \times 10^{-5}$ | 0 |
| C | $2.0 \times 10^{-2}$ | $0.9 \times 10^{-2}$ | $5.0 \times 10^{-4}$ | $1.0 \times 10^{-4}$ |
| D | $2.0 \times 10^{-2}$ | $0.9 \times 10^{-2}$ | $1.0 \times 10^{-5}$ | $2.0 \times 10^{-6}$ |
| E | $3.2 \times 10^{-2}$ | $2.0 \times 10^{-2}$ | $7.0 \times 10^{-6}$ | 0 |

The optical density of the color images thus—obtained was measured to obtain the characteristic curve. The variation of photographic performance before and after the continuous processing was determined with respect to the maximum density ($D_{min}$), sensitivity (s) and gradation ($\gamma$). Further, the granularity (R.M.S.) after the continuous processing was completed was measured.

With respect to the minimum density ($D_{min}$), the difference ($\Delta D_{min}$) between $D_{min}$ before the continuous processing and $D_{min}$ after the continuous processing was determined.

With respect to the sensitivity (S), the exposure amount (log E) necessary to provide a density of $D_{min}+0.2$ was measured, and the difference ($\Delta S$) between the log E value before the continuous processing and the log E value after the continuous processing was determined. Also, the granularity (R.M.S.) was measured at the position having a density of 1.0 where the gray exposure was stepwise carried out at a color temperature of 4800° K.

With respect to gradation, the density corresponding to an exposure amount of a point determined by adding 1.5 in a logarithm value of amount of exposure on the higher exposure amount side to a point of exposure amount (log E) providing a density of $D_{min}+0.2$ in the sample before the continuous processing was measured, and a density corresponding to the same exposure amount after the continuous processing was also measured. The difference ($\Delta_\gamma$) of these values was then determined.

The variation in photographic performance due to the continuous processing was determined with a magenta color image. The results obtained are shown in Table 1-2 below.

TABLE 1-2

| Processing No. | Compound | Processing Solution | Halide Ion Concentration under Equilibrium Condition of Running: Bromide Ion (mol/l) | Halide Ion Concentration under Equilibrium Condition of Running: Iodide Ion (mol/l) | Photographic Performance: $\Delta D_{min}$ | $\Delta S$ | $\Delta\gamma$ | R.M.S. | Remark |
|---|---|---|---|---|---|---|---|---|---|
| 1-1 | Compound X | A | $0.6 \times 10^{-2}$ | $4.7 \times 10^{-4}$ | 0.10 | 0.09 | 0.12 | 0.011 | Comparison |
| 1-2 | " | B | $0.6 \times 10^{-2}$ | $1.2 \times 10^{-5}$ | 0.13 | 0.09 | 0.10 | 0.011 | " |
| 1-3 | " | C | $2.1 \times 10^{-2}$ | $4.7 \times 10^{-4}$ | 0.08 | 0.11 | 0.11 | 0.012 | " |
| 1-4 | " | D | $2.1 \times 10^{-2}$ | $2.9 \times 10^{-5}$ | 0.09 | 0.09 | 0.09 | 0.011 | " |
| 1-5 | " | E | $3.1 \times 10^{-2}$ | $7.2 \times 10^{-6}$ | 0.08 | 0.07 | 0.10 | 0.012 | " |
| 1-6 | Compound (2) | A | $0.6 \times 10^{-2}$ | $4.7 \times 10^{-4}$ | 0.05 | 0.07 | 0.08 | 0.011 | " |
| 1-7 | " | B | $0.6 \times 10^{-2}$ | $1.2 \times 10^{-5}$ | 0.08 | 0.06 | 0.05 | 0.010 | " |
| 1-8 | " | C | $2.1 \times 10^{-2}$ | $4.7 \times 10^{-4}$ | 0.02 | 0.09 | 0.09 | 0.010 | " |
| 1-9 | " | D | $2.1 \times 10^{-2}$ | $2.9 \times 10^{-5}$ | 0.02 | 0.03 | 0.03 | 0.007 | Present Invention |
| 1-10 | " | E | $3.1 \times 10^{-2}$ | $7.2 \times 10^{-6}$ | 0.00 | 0.01 | 0.01 | 0.006 | " |
| 1-11 | Compound Y | D | $2.1 \times 10^{-2}$ | $2.9 \times 10^{-5}$ | 0.12 | 0.07 | 0.09 | 0.010 | Comparison |
| 1-12 | Compound (7) | D | $2.1 \times 10^{-2}$ | $2.9 \times 10^{-5}$ | 0.02 | 0.03 | 0.02 | 0.007 | Present Invention |
| 1-13 | Compound (13) | E | $3.1 \times 10^{-2}$ | $7.2 \times 10^{-6}$ | 0.01 | 0.01 | 0.01 | 0.007 | " |
| 1-14 | Compound (14) | D | $2.1 \times 10^{-2}$ | $2.9 \times 10^{-5}$ | 0.02 | 0.03 | 0.03 | 0.006 | " |
| 1-15 | Compound (17) | E | $3.1 \times 10^{-2}$ | $7.2 \times 10^{-6}$ | 0.00 | 0.01 | 0.01 | 0.007 | " |

Compound X: Diethylhydroxylamine
Compound Y: Hydoxylamine sulfate

As is apparent from the results shown in Table 1-2, the variation in photographic performance after continuous processing is remarkably small when the color developing solution contains a compound represented by formula (I) and the bromide ion concentration and iodide ion concentrations are within the prescribed ranges according to the present invention.

As is apparent from the comparison of Processing Nos. 1-9 and 1-10 with Processing Nos. 1-7 and 1-8, it is clearly seen that the variation of any one of $D_{min}$, sensitivity (S) and gradation ($\gamma$) is large and that photographic performance is deteriorated when any one of the bromide ion concentration or iodide ion concentration departs from the prescribed range in accordance with the present invention. Also, as is apparent from the results of Table 1-2, Processing Nos. 1-9, 1-10, 1-12 to 1-15 according to the present invention were improved with respect to the granularity after the continuous processing.

When the color developing solution contains diethylhydroxylamine for comparison, the variation of photographic performance is large even when the halide ion concentrations are within the prescribed ranges in accordance with the present invention. The same results were obtained with respect to hydroxylamine as the comparative compound.

It is clearly seen from the above results that stable processing with small variation in photographic performance is obtained only by using a color developing solution containing the compound represented by formula (I) wherein the bromide ion concentration and iodide ion concentration are maintained within the prescribed range in accordance with the present invention in the color developing solution.

EXAMPLE 2

Sample 101 as prepared in Example 1 was exposed in the same manner as described in Example 1. The sample was then processed according to the processing steps described below, wherein the amount of replenishment for the color developing solution in continuous processing was varied as shown in Table 2-1 below. The continuous processing of the imagewise exposed sample was conducted until an accumulated amount of replenisher for the color developing solution reached three times the tank capacity of start liquor. The processing for evaluating photographic performance was conducted before and after the continuous processing.

| Processing Step | Processing Time | Processing Temperature (°C.) | Amount of* Replenishment (ml) | Tank Capacity (l) |
|---|---|---|---|---|
| Color Development | 3 min. 15 sec. | 38.0 | Shown in Table 2-1 | 15 |
| Bleaching | 50 sec. | 38.0 | 130 | 5 |
| Bleach-Fixing | 50 sec. | 38.0 | — | 5 |
| Fixing | 50 sec. | 38.0 | 800 | 5 |
| Washing with Water (1) | 30 sec. | 38.0 | — | 3 |
| Washing with Water (2) | 20 sec. | 38.0 | 800 | 3 |
| Stabilizing | 20 sec. | 38.0 | 530 | 3 |
| Drying | 1 min. | 55 | — | — |

*Amount of replenishment per $m^2$ of light-sensitive materials

The water washing was conducted using a counter-current system from tanks (2) to (1), and the entire overflow solution of the washing water was introduced into the fixing bath. The replenishment for the bleach-fixing bath was effected by connecting the upper portion of the bleaching tank with the bottom of the bleach-fixing tank by a pipe, and connecting the upper portion of the fixing tank with a bottom of the bleach-fixing tank by a pipe in the automatic developing machine, such that the entire overflow solution due to supply of the replenisher to the bleaching tank and fixing tank was introduced into the bleach-fixing tank. The amount of developing solution carried over to the bleaching step, the amount of bleaching solution carried over to the bleach-fixing step, the amount of bleach-fixing solution carried over to the fixing step and the amount of fixing solution carried over to the washing with water step were 2.5 ml, 2.0 ml, 2.0 ml and 2.0 ml per meter of the 35 mm wide light-sensitive material thus processed, respectively. The crossover time for each type was 5 seconds, and this time is included in the processing time for the former step in the processing sequence.

The composition of each processing solution used is illustrated below.

-continued

| Color Developing Solution: | Start Liquor | Replenisher |
|---|---|---|
| Sodium sulfite | 3.9 g | 5.2 g |
| Potassium carbonate | 37.5 g | 39.0 g |
| Potassium bromide | 2.5 g | Shown in Table 2-1 |
| Potassium iodide | 1.3 mg | — |
| Compound (Shown in Table 2-2) | $3.0 \times 10^{-2}$ mol | $4.5 \times 10^{-2}$ mol |
| 2-Methyl-4-(N-ethyl-N-(β-hydroxy-ethyl)amino)aniline sulfate | 6.0 g | Shown in Table 201 |
| Water to make | 1.0 l | 1.0 l |
| pH | Shown in Table 2-1 | |

Bleaching Solution:

Same as the start liquor and replenisher used in Example 1.

Bleach-Fixing Solution:

Same as the start liquor and replenisher used in Example 1.

Fixing Solution:

Same as the start liquor and replenisher used in Example 1.

Washing Water:

Same as the start liquor and replenisher used in Example 1.

Stabilizing Solution:

Same as the start liquor and replenisher used in Example 1.

TABLE 2-1

| Processing Solution | Amount of Replenishment ($ml/m^2$) | Replenisher for Color Developing Solution: Color Developing Agent (g/l) | Replenisher for Color Developing Solution: Potassium Bromide (g/l) | pH: Start Liquor | pH: Replenisher | Halide Ion Concentration under Equilibrium Condition of Running: Bromide Ion (mol/l) | Halide Ion Concentration under Equilibrium Condition of Running: Iodide Ion (mol/l) |
|---|---|---|---|---|---|---|---|
| F | 700 | 8.1 | 1.1 | 10.05 | 10.10 | $2.1 \times 10^{-2}$ | $7.8 \times 10^{-6}$ |
| G | 500 | 8.5 | 0.4 | 10.05 | 10.10 | $2.1 \times 10^{-2}$ | $7.8 \times 10^{-6}$ |
| H | 300 | 10.1 | 0.0 | 10.10 | 10.25 | $2.5 \times 10^{-2}$ | $7.9 \times 10^{-6}$ |
| I | 100 | 13.0 | 0.0 | 10.15 | 10.35 | $2.7 \times 10^{-2}$ | $8.0 \times 10^{-6}$ |

| Color Developing Solution: | Start Liquor | Replenisher |
|---|---|---|
| Diethylenetriaminepenta-acetic acid | 2.0 g | 2.2 g |
| 1-Hydroxyethylidene-1,1-diphosphonic acid | 3.3 g | 3.3 g |

The optical density of each sample thus obtained was measured to obtain the characteristic curve as in Example 1. The variation of photographic performance before and after the continuous processing was determined with respect to a magenta color image in the same manner as described in Example 1. The results obtained are shown in Table 2-2 below.

TABLE 2-2

| Processing No. | Processing Solution | Compound | Photographic Performance: $\Delta D_{min}$ | Photographic Performance: $\Delta S$ | Photographic Performance: $\Delta\gamma$ | Remark |
|---|---|---|---|---|---|---|
| 2-1 | F | Compound X | 0.06 | 0.07 | 0.04 | Comparison |
| 2-2 | G | " | 0.07 | 0.08 | 0.06 | " |
| 2-3 | H | " | 0.08 | 0.09 | 0.07 | " |

TABLE 2-2-continued

| Processing No. | Processing Solution | Compound | Photographic Performance $\Delta D_{min}$ | $\Delta S$ | $\Delta\gamma$ | Remark |
|---|---|---|---|---|---|---|
| 2-4 | I | " | 0.09 | 0.09 | 0.08 | " |
| 2-5 | F | Compound (2) | 0.00 | 0.01 | 0.02 | Present Invention |
| 2-6 | G | " | 0.01 | 0.02 | 0.02 | " |
| 2-7 | H | " | 0.02 | 0.02 | 0.02 | " |
| 2-8 | I | " | 0.02 | 0.02 | 0.02 | " |
| 2-9 | H | Compound Y | 0.05 | 0.06 | 0.09 | Comparison |
| 2-10 | H | Compound (8) | 0.01 | 0.02 | 0.02 | Present Invention |
| 2-11 | H | Compound (11) | 0.01 | 0.02 | 0.02 | " |
| 2-12 | H | Compound (53) | 0.01 | 0.01 | 0.02 | " |

Compound X: Diethylhydroxylamine
Compound Y: Hydroxylamine sulfate

As is apparent from the results shown in Table 2-2 above, the variation in photographic performance is remarkably small when the color developing solution contains a compound represented by formula (I) and the bromide ion concentration and iodide ion concentrations are within the prescribed ranges in accordance with the present invention, even when using low level replenishment processing in an amount of 700 ml or less per $m^2$ of the photographic material processed.

EXAMPLE 3

Sample 101 as prepared in Example 1 was exposed in the same manner as described in Example 1. The sample was then processed according to the processing steps described below, wherein the type of preservative contained in the color developing solution was varied as shown in Table 3 below. The continuous processing was conducted until an accumulated amount of replenisher for the color developing solution reached three times the tank capacity of start liquor using the imagewise exposed sample. The processing for evaluating photographic performance was conducted before and after the continuous processing as in Example 1.

With respect to the halide ion concentration in the color developing solution after the continuous processing, the bromide ion concentration was $3.5\times10^{-2}$ mol/l and the iodide ion concentration was $8.0\times10^{-6}$ mol/l.

| Processing Step | Processing Time | Processing Temperature (°C.) | Amount of (*1) Replenishment (ml) | Tank Capacity (l) |
|---|---|---|---|---|
| Color Development | 3 min. 15 sec. | 38 | 600 | 10 |
| Bleaching | 1 min. 00 sec. | 38 | 130 | 4 |
| Bleach-Fixing | 3 min. 15 sec. | 38 | 800 | 8 |
| Washing with Water (1) | 40 sec. | 35 | (*2) | 4 |
| Washing with Water (2) | 1 min. 00 sec. | 35 | 800 | 4 |
| Stabilizing | 40 sec. | 38 | 530 | 4 |
| Drying | 1 min. 15 sec. | 55 | — | — |

(*1) Amount of replenishment per $m^2$ of light-sensitive materials
(*2) Countercurrent piping system from Washing with Water (2) to Washing with Water (1)

The composition of each processing solution used is illustrated below.

| | Start Liquor | Replenisher |
|---|---|---|
| Color Developing Solution: | | |
| Diethylenetriaminepenta-acetic acid | 1.0 g | 1.1 g |
| 1-Hydroxyethylidene-1,1-diphosphonic acid | 3.0 g | 3.3 g |
| Sodium sulfite | 4.0 g | 5.0 g |
| Potassium carbonate | 30.0 g | 38.0 g |
| Potassium bromide | 2.9 g | 0.7 g |
| Potassium iodide | 1.5 mg | — |
| Compound (Shown in Table 3) | $3.0\times10^{-2}$ mol | $4.5\times10^{-2}$ mol |
| 4-(N-Ethyl-N-β-hydroxyethylamino)-2-methylaniline sulfate | 5.0 g | 7.5 g |
| Water to make | 1.0 l | 1.0 l |
| pH | 10.10 | 10.30 |
| Bleaching Solution: (both Start Liquor and replenisher) | | |
| Ammonium iron(III) ethylenediaminetetraacetate dihydrate | | 120.0 g |
| Disodium ethylenediaminetetraacetate | | 10.0 g |
| Ammonium bromide | | 100.0 g |
| Ammonium nitrate | | 10.0 g |
| Bleaching accelerator | | 0.005 mol |

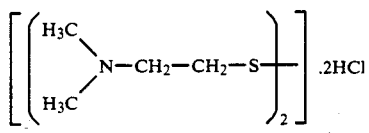

| | |
|---|---|
| Aqueous ammonia (27 wt %) | 15.0 ml |
| Water to make | 1.0 l |
| pH | 6.3 |
| Bleach-Fixing Solution: (both start liquor and replenisher) | |
| Ammonium iron(III) ethylenediaminetetraacetate dihydrate | 50.0 g |
| Disodium ethylenediaminetetraacetate | 5.0 g |
| Sodium sulfite | 12.0 g |
| Aqueous solution of ammonium thiosulfate (700 g/l) | 240.0 ml |
| Aqueous ammonia (27 wt %) | 6.0 ml |
| Water to make | 1.0 l |
| pH | 7.2 |

Washing Water: (both tank solution and replenisher)

City water was passed through a mixed bed type column filled with an H type strong acidic cation exchange resin ("Amerlite IR-120B" manufactured by Rhom & Haas Co.) and an OH type anion exchange resin ("Amberlite IR-400" manufactured by Rhom % Haas Co.) to prepare water containing not more than 3 mg/l of calcium ion and magnesium ion, respectively. To the water thus—treated were added sodium dichloroisocyanurate in an amount of 20 mg/l and sodium sulfate in an amount of 0.15 g/l. The pH of the solution was in the range of from 6.5 to 7.5.

| Stabilizing Solution: (both start liquor and replenisher) | |
|---|---|
| Formalin (37 wt %) | 2.0 ml |
| Polyoxyethylene-p-monononylphenylether (average degree of polymerization: 10) | 0.3 g |
| Disodium ethylenediaminetetraacetate | 0.05 g |
| Water to make | 1.0 l |
| pH | 5.0 to 8.0 |

The optical density of each sample thus obtained was measured to obtain the characteristic curve. The variation of photographic performance before and after the continuous processing was determined with respect to the magenta color image in the same manner as described in Example 1.

Furthermore, the continuously processed samples were stored under high temperature and high humidity conditions of 80° C. and 70% RH, and the occurrence of stains in the uncolored portions thereof was evaluated. The change in staining was evaluated as the difference ($\Delta D_B$) between the density as measured by blue light after storage and the density as measured before storage. The results are shown in Table 3 below.

Moreover, a part of each color developing solution containing the preservative was stored in a polyethylene container just after the preparation thereof and stored at 40° C. for 10 days. Then, the amount of the color developing agent in the color developing solution was measured by high speed liquid chromatography, and the remaining proportion thereof was determined. The evaluation was conducted using the following grades.

| Remaining proportion of developing agent (%) | Grade |
|---|---|
| 95 to 100 | E |
| 85 to 94 | G |
| 75 to 84 | F |
| 74 or less | P |

The results are also shown in Table 3 below.

TABLE 3

| Processing No. | Compound | Photographic Performance $\Delta D_{min}$ | $\Delta S$ | $\Delta\gamma$ | $\Delta D_B$ | Evaluation of Remaining Proportion of Developing Aent | Remark |
|---|---|---|---|---|---|---|---|
| 3-1 | Hydroxylamine sulfate | 0.12 | 0.12 | 0.09 | 0.25 | P | Comparison |
| 3-2 | Diethyl-hydroxylamine | 0.07 | 0.09 | 0.08 | 0.23 | F | " |
| 3-3 | Dimethoxyethyl-hydroxylamine | 0.07 | 0.08 | 0.08 | 0.23 | F | " |
| 3-4 | Compound (2) | 0.00 | 0.01 | 0.02 | 0.08 | E | Present Invention |
| 3-5 | Compound (6) | 0.00 | 0.01 | 0.02 | 0.08 | E | " |
| 3-6 | Compound (13) | 0.01 | 0.01 | 0.02 | 0.08 | E | " |
| 3-7 | Compound (15) | 0.03 | 0.02 | 0.03 | 0.10 | G | " |
| 3-8 | Compound (26) | 0.01 | 0.02 | 0.03 | 0.08 | G | " |
| 3-9 | Compound (39) | 0.01 | 0.02 | 0.04 | 0.09 | G | " |
| 3-10 | Compound (44) | 0.01 | 0.01 | 0.02 | 0.08 | E | " |
| 3-11 | Compound (48) | 0.02 | 0.02 | 0.02 | 0.09 | G | " |
| 3-12 | Compound (55) | 0.03 | 0.02 | 0.02 | 0.10 | G | " |

As is apparent from the results shown in Table 3, the compounds represented by formula (I) provide stable photographic performance and little occurrence of staining upon storage of the processed color photographic material under the above described high temperature and high humidity conditions. Furthermore, the compounds represented by formula (I) of the present invention provides superior preservative function as shown in the high remaining proportion of the color developing agent after storage.

EXAMPLE 4

A cellulose triacetate film support provided with a subbing layer was coated with the layers having the composition as set forth below, to prepare a multilayer color light-sensitive material designated Sample 401.

With respect to the compositions of the layers, the coating amounts are given in units of g/m$^2$, coating amounts of silver halide are given in terms of the silver coating amount in units of g/m$^2$, and those of the sensitizing dyes are given as a molar amount per mol of silver halide contained in the same layer.

| | |
|---|---|
| First Layer: Antihalation Layer | |
| Black colloidal silver | 0.18 (as silver) |
| Gelatin | 0.40 |
| Second Layer: Intermediate Layer | |
| 2,5-Di-tert-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer: First Red-Sensitive Emulsion Layer | |
| Emulsion A | 0.25 (as silver) |
| Emulsion B | 0.25 (as silver) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.335 |
| EX-10 | 0.020 |
| HBS-1 | 0.060 |
| Gelatin | 0.87 |
| Fourth Layer: Second Red-Sensitive Emulsion Layer | |
| Emulsion C | 1.0 (as silver) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.400 |
| EX-3 | 0.050 |
| EX-10 | 0.015 |
| HBS-1 | 0.060 |
| Gelatin | 1.30 |
| Fifth Layer: Third Red-Sensitive Emulsion Layer | |
| Emulsion D | 1.60 |

-continued

| | |
|---|---|
| | (as silver) |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.63 |
| Sixth Layer: Intermediate Layer | |
| EX-5 | 0.040 |
| HBS-1 | 0.020 |
| Gelatin | 0.80 |
| Seventh Layer: First Green-Sensitive Emulsion Layer | |
| Emulsion A | 0.15 (as silver) |
| Emulsion B | 0.15 (as silver) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-3 | 0.010 |
| Gelatin | 0.63 |
| Eighth Layer: Second Green-Sensitive Emulsion Layer | |
| Emulsion C | 0.45 (as silver) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.094 |
| EX-8 | 0.018 |
| EX-7 | 0.026 |
| HBS-1 | 0.160 |
| HBS-3 | 0.008 |
| Gelatin | 0.50 |
| Ninth Layer: Third Green-Sensitive Emulsion Layer | |
| Emulsion E | 1.2 (as silver) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |

-continued

| | |
|---|---|
| Tenth Layer: Yellow Filter Layer | |
| Yellow colloidal silver | 0.05 (as silver) |
| EX-5 | 0.08 |
| HBS-1 | 0.03 |
| Gelatin | 0.95 |
| Eleventh Layer: First Blue-Sensitive Emulsion Layer | |
| Emulsion A | 0.08 (as silver) |
| Emulsion B | 0.07 (as silver) |
| Emulsion F | 0.07 (as silver) |
| Sensitizing dye VIII | $3.5 \times 10^{-4}$ |
| EX-9 | 0.721 |
| EX-8 | 0.042 |
| HBS-1 | 0.28 |
| Gelatin | 1.10 |
| Twelfth Layer: Second Blue-Sensitive Emulsion Layer | |
| Emulsion G | 0.45 (as silver) |
| Sensitizing dye VIII | $2.1 \times 10^{-4}$ |
| EX-9 | 0.154 |
| EX-10 | 0.007 |
| HBS-1 | 0.05 |
| Gelatin | 0.78 |
| Thirteenth Layer: Third Blue-Sensitive Emulsion Layer | |
| Emulsion H | 0.77 (as silver) |
| Sensitizing dye VIII | $2.2 \times 10^{-4}$ |
| EX-9 | 0.20 |
| HBS-1 | 0.07 |
| Gelatin | 0.69 |
| Fourteenth Layer: First Protective Layer | |
| Emulsion I | 0.5 (as silver) |
| U-4 | 0.11 |
| U-5 | 0.17 |
| HBS-1 | 0.05 |
| Gelatin | 1.00 |
| Fifteenth Layer: Second Protective Layer | |
| Polymethyl methacrylate particle (diameter: about 1.5 μm) | 0.54 |
| S-1 | 0.20 |
| Gelatin | 1.20 |

Gelatin Hardener H-1 and a surface active agent were added to each of the layers in addition to the above described components.

| Emulsion | Average AgI Content (%) | Average Particle Diameter (μm) | Coefficient of Variation on Particle Diameter (%) | Diameter/ Thickness Ratio | Ratio of Silver Amount (AgI Content mol %) |
|---|---|---|---|---|---|
| A | 4.1 | 0.45 | 27 | 1 | Double Structure Grain Core/Shell = 1/3 (13/1) |
| B | 8.9 | 0.70 | 14 | 1 | Double Structure Grain Core/Shell = 3/7 (25/2) |
| C | 10 | 0.75 | 30 | 2 | Double Structure Grain Core/Shell = 1/2 (24/3) |
| D | 16 | 1.05 | 35 | 2 | Double Structure Grain Core/Shell = 1/2 (40/0) |
| E | 10 | 1.05 | 35 | 3 | Double Structure Grain Core/Shell = 1/2 (24/3) |
| F | 4.1 | 0.25 | 28 | 1 | Double Structure Grain Core/Shell = 1/3 (13/1) |
| G | 13.6 | 0.75 | 25 | 2 | Double Structure Grain Core/Shell = 1/2 (40/0) |
| H | 14 | 1.30 | 25 | 3 | Double Structure Grain Core/Shell = 37/63 (34/3) |
| I | 1 | 0.07 | 15 | 1 | Uniform Grain |

The components employed for the preparation of the light-sensitive material are shown below.

EX-1
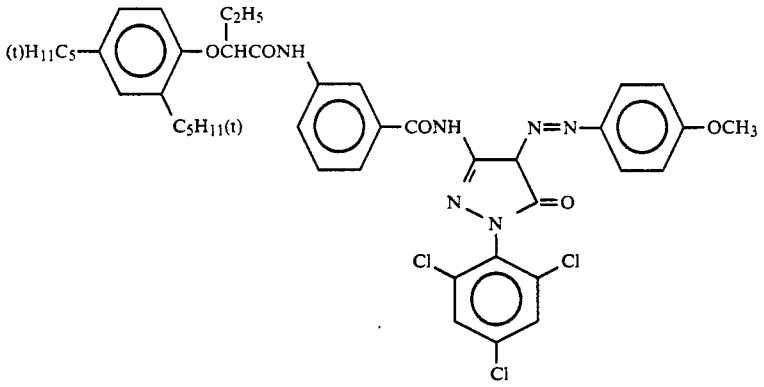
EX-2
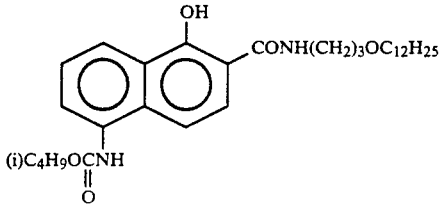
EX-3
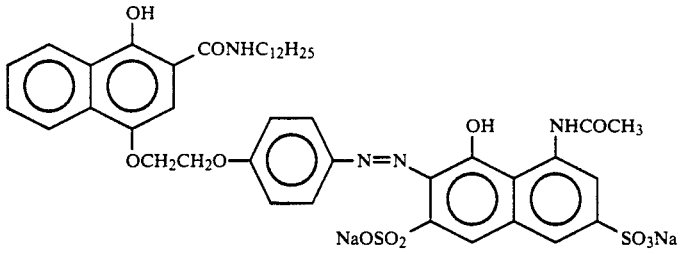
EX-4
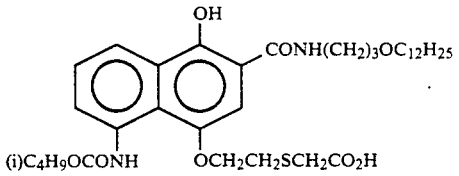
EX-5
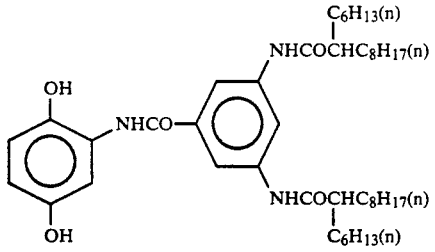
EX-6
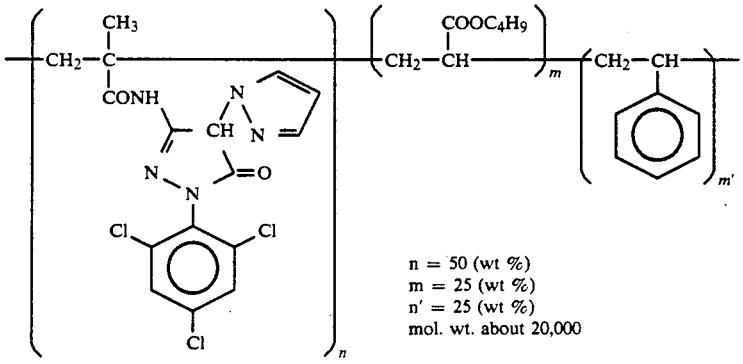
n = 50 (wt %)
m = 25 (wt %)
n' = 25 (wt %)
mol. wt. about 20,000

-continued
EX-7
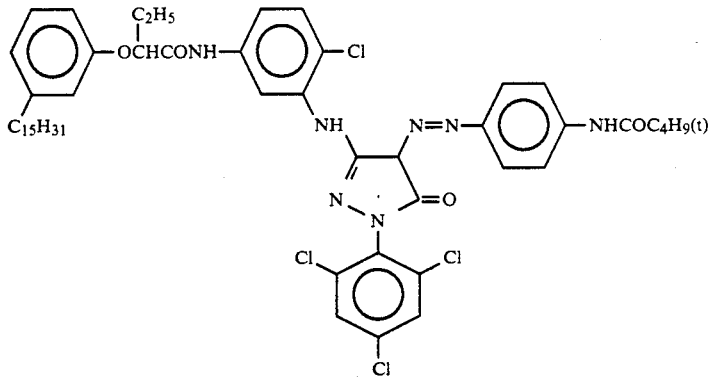
EX-8
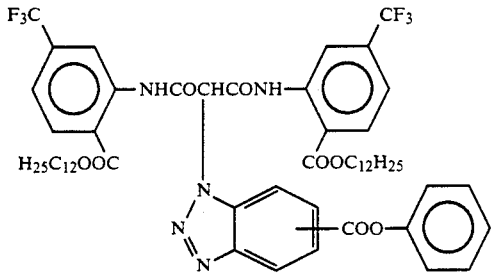
EX-9
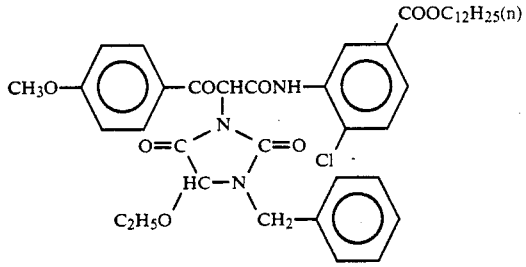
EX-10
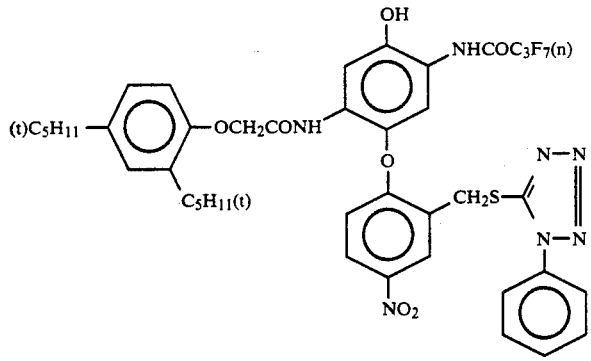

-continued
EX-11
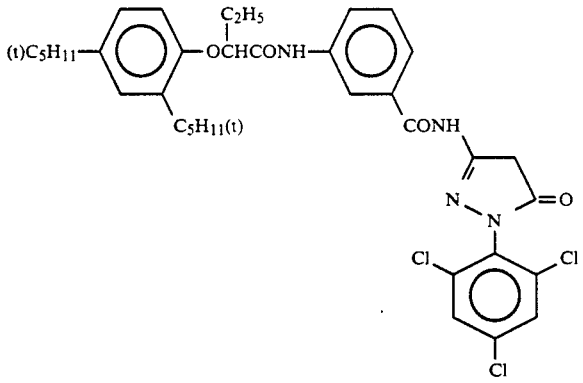
EX-12
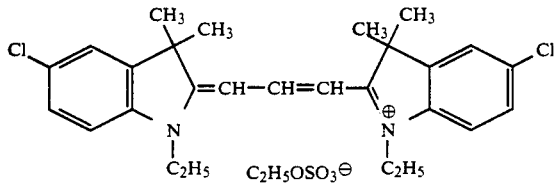
EX-13
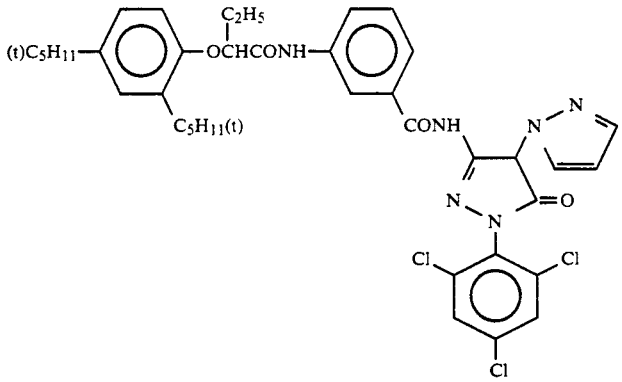
U-1
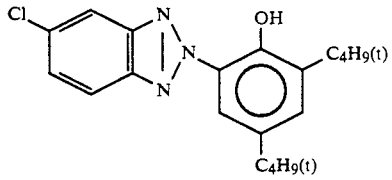
U-2
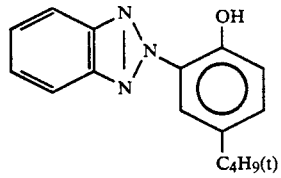
U-3
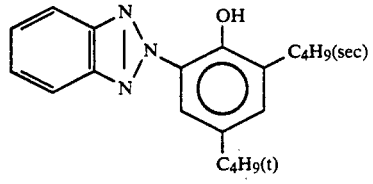

-continued
U-4
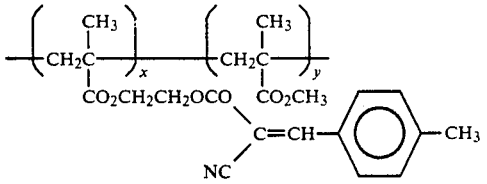
x:y = 70:30 (wt %)
UV-5
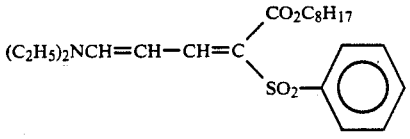
Tricresyl phosphate — HBS-1
Di-n-butyl phthalate — HBS-2
HBS-3
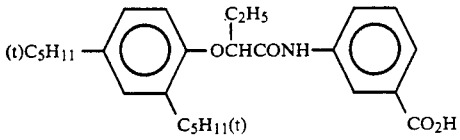
Sensitizing Dye I
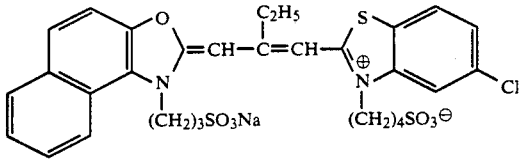
Sensitizing Dye II
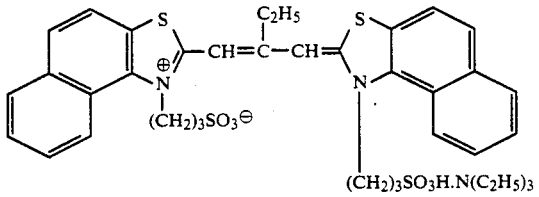
Sensitizing Dye III
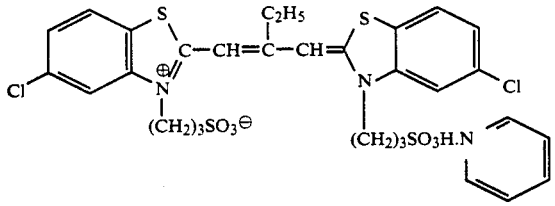
Sensitizing Dye V
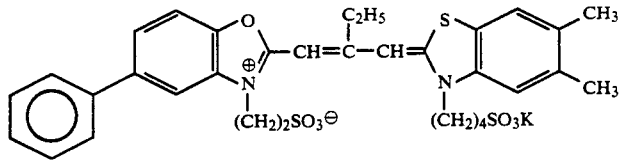
Sensitizing Dye VI
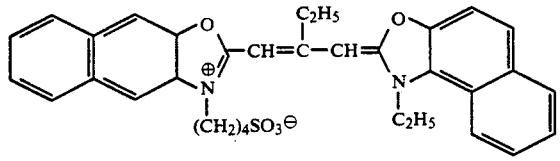

-continued

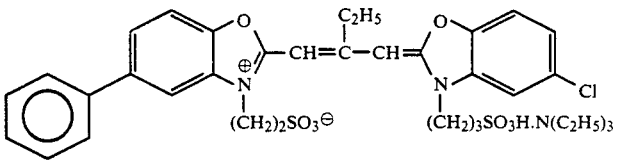

Sensitizing Dye VII

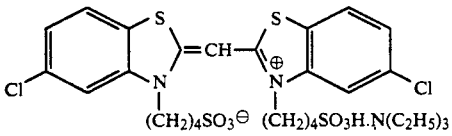

Sensitizing Dye VIII

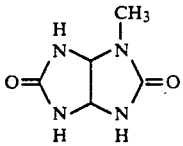

S-1

$CH_2{=}CH{-}SO_2{-}CH_2{-}CONH{-}CH_2$
$CH_2{=}CH{-}SO_2{-}CH_2{-}CONH{-}CH_2$

H-1

Using Sample 401 thus-prepared, the exposure and processing was conducted in the same manner as described in Example 1, except for modifying the color developing solution by changing the concentration of potassium bromide to $2.2\times10^{-2}$ mol/l ($0.8\times10^{-3}$ mol/l in the replenisher), changing the concentration of potassium iodide to $7.6\times10^{-6}$ mol/l (not added in the replenisher), and changing the Compound as indicated in Table 4 below.

The variation in photographic performance prior to and after continuous processing was evaluated as in Example 1, the results of which are shown in Table 4 below.

TABLE 4

| Processing No. | Compound | Amount in Tank Solution (mol/l) | Amount in Replenisher (mol/l) | Photographic Performance $\Delta D_{min}$ | $\Delta S$ | $\Delta\gamma$ | R.M.S. | Remark |
|---|---|---|---|---|---|---|---|---|
| 4-1 | Diethyl-hydroxylamine | 6.0 | 9.0 | 0.09 | 0.09 | 0.07 | 0.014 | Comparison |
| 4-2 | Diethyl-hydroxylamine | 6.0 | 9.0 | 0.09 | 0.09 | 0.06 | 0.013 | " |
| | Compound (II-3) | 8.0 | 10.0 | | | | | |
| 4-3 | Diethyl-hydroxylamine | 6.0 | 9.0 | 0.08 | 0.08 | 0.05 | 0.014 | " |
| 4-4 | Diethyl-hydroxylamine | 6.0 | 9.0 | 0.08 | 0.07 | 0.05 | 0.013 | " |
| | Compound (II-3) | 8.0 | 10.0 | | | | | |
| 4-5 | Compound (7) | 6.0 | 9.0 | 0.03 | 0.03 | 0.02 | 0.008 | Present Invention |
| 4-6 | Compound (7) | 6.0 | 9.0 | 0.01 | 0.01 | 0.00 | 0.008 | " |
| | Compound (II-3) | 8.0 | 10.0 | | | | | |
| 4-7 | Compound (14) | 6.0 | 9.0 | 0.04 | 0.04 | 0.03 | 0.009 | " |
| 4-8 | Compound (14) | 6.0 | 9.0 | 0.02 | 0.01 | 0.01 | 0.009 | " |
| | Compound (II-3) | 8.0 | 10.0 | | | | | |
| 4-9 | Compound (2) | 6.0 | 9.0 | 0.00 | 0.00 | 0.00 | 0.008 | Present Invention |
| | Compound (II-3 | 8.0 | 10.0 | | | | | |
| | Compound (B-I-2) | 0.6 | 0.8 | | | | | |
| 4-10 | Compound (14) | 6.0 | 9.0 | 0.01 | 0.00 | 0.00 | 0.008 | Present Invention |
| | Compound (II-3) | 8.0 | 10.0 | | | | | |
| | Compound (B-II-1) | 0.6 | 0.8 | | | | | |

As is apparent from the results shown in Table 4, the compound represented by formula (I) provides enhanced photographic performance when used in combination with the compound represented by formula (II) and further in combination with the compound represented by formulae (B-I) or (B-II) in accordance with the present invention.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material which comprises continuously processing an imagewise exposed silver halide color photographic material comprising a support having thereon at least one silver halide emulsion layer containing silver halide having a silver iodide content of at least 2 mol % with a color developing solution, wherein said color developing solution contains at least one compound represented by formula (I); and the bromide ion concentration in said color developing solution is maintained to from $2.5\times10^{-2}$ to $1\times10^{-1}$ mol per liter and the iodide ion concentration in said color developing solution is maintained to from $5.0\times10^{-7}$ to $1.0\times10^{-5}$ mol per liter:

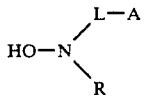

(I)

wherein L represents an alkylene group; A represents a carboxy group, a sulfo group, a phosphono group, a phosphinic acid residual group, a hydroxy group, an unsubstituted amino group or an amino group which is substituted with an alkyl group, an unsubstituted ammonio group or an ammonio group which is substituted with an alkyl group, an unsubstituted carbamoyl group or a carbamoyl group which is substituted with an alkyl group, an unsubstituted with an sulfamoyl group or a sulfamoyl group which is substituted with an alkyl group, or an alkylsulfonyl group; and R represents a hydrogen atom or an alkyl group.

2. A method for processing a silver halide color photographic material as in claim 1, wherein the alkylene group represented by L is a straight chain or branched chain alkyl group having from 1 to 10 carbon atoms.

3. A method for processing a silver halide color photographic material as in claim 1, wherein the alkyl group represented by R is a straight chain or branched chain alkyl group having from 1 to 10 carbon atoms.

4. A method for processing a silver halide color photographic material as in claim 1, wherein the color developing solution contains a compound represented by formula (I) in an amount of from 0.1 to 50 g per liter of the color developing solution.

5. A method for processing a silver halide color photographic material as in claim 1, wherein the color developing solution further contains a compound represented by formula (II):

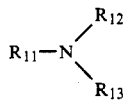

(II)

wherein $R_{11}$ represents a hydroxyalkyl group having from 2 to 6 carbon atoms, and $R_{12}$ and $R_{13}$ each represents a hydrogen atom, an unsubstituted alkyl group having from 1 to 6 carbon atoms, a hydroxyalkyl group having from 2 to 6 carbon atoms, a benzyl group or the group

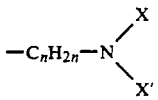

wherein n represents an integer of from 1 to 6, and X and X' each represents a hydrogen atom, an unsubstituted alkyl group having from 1 to 6 carbon atoms or a hydroxyalkyl group having from 2 to 6 carbon atoms.

6. A method for processing a silver halide color photographic material as in claim 5, wherein the color developing solution contains a compound represented by formula (II) in an amount of from 3 to 100 g per liter of the color developing solution.

7. A method for processing a silver halide color photographic material as in claim 1, wherein the color developing solution further contains a compound represented by formula (B-I) or (B-II):

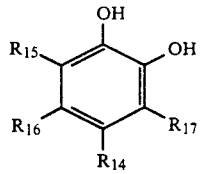

(B-I)

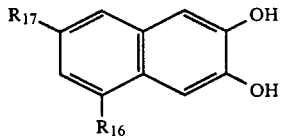

(B-II)

wherein $R_{14}$, $R_{15}$, $R_{16}$ and $R_{17}$ each represents a hydrogen atom, a halogen atom, a sulfonic acid group, an alkyl group having from 1 to 7 carbon atoms, $-OR_{18}$, $-COOR_{19}$,

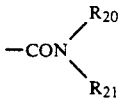

or a phenyl group; and $R_{18}$, $R_{19}$, $R_{20}$ and $R_{21}$ each represents a hydrogen atom or an alkyl group having from 1 to 18 carbon atoms, provided that when $R_{15}$ represents —OH or a hydrogen atom, $R_{14}$ represents a halogen atom, a sulfonic acid group, an alkyl group having from 1 to 7 alkyl group, $-OR^{18}$, $-COOR^{19}$,

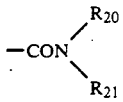

or a phenyl group.

8. A method for processing a silver halide color photographic material as in claim 7, wherein the color developing solution contains a compound represented by the formula (B-I) or (B-II) in an amount of from 5 mg to 15 g per liter of the color developing solution.

9. A method for processing a silver halide color photographic material as in claim 1, wherein the silver halide emulsion layer contains silver iodobromide, silver iodochloride or silver iodochlorobromide each containing from about 2 to 30 mol % of silver iodide.

10. A method for processing a silver halide color photographic material as in claim 1, wherein said R represents a hydrogen atom or an alkyl group which is substituted with a substituent selected form the group consisting of a carboxy group, a hydroxy group, a sulfo group, a phosphono group, an amino group which is substituted with an alkyl group, an ammonio group which is substituted with an alkyl group.

11. A method for processing a silver halide color photographic material as in claim 1, wherein said R represents an alkyl group which is substituted with a substituent selected from the group consisting of a carboxy group, a sulfo group and a phosphono group.

12. A method for processing a silver halide color photographic material as in claim 1, wherein said A represents a carboxy group, a sulfo group, a hydroxy group, a phosphono group, an unsubstituted carbamoyl group or a carbamoyl group which is substituted with an alkyl group.

13. A method for processing a silver halide color photographic material as in claim 1, wherein said silver halide color photographic material comprises a support having thereon at least one light-sensitive unit layer composed of a plurality of silver halide emulsion layer substantially the same sensitivity by different photographic speeds.

14. A method for processing a silver halide color photographic material as in claim 1, wherein the silver bromide ion and silver iodide ion are directly added to the color developing solution or are eluted from the light-sensitive material during processing in order to maintain the silver bromide ion concentration and the silver iodide ion concentration to said range.

* * * * *